US008728186B2

(12) United States Patent
Kim et al.

(10) Patent No.: US 8,728,186 B2
(45) Date of Patent: May 20, 2014

(54) VACUUM CLEANER AND DUST SEPARATING APPARATUS THEREOF

(75) Inventors: Tak Soo Kim, Seo-gu (KR); Cheol Ho Choi, Gwangsan-gu (KR); Jun Won Seo, Yeonsu-gu (KR); Jin Ho Lee, Gwangsan-gu (KR); Keon Soo Choi, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/600,906

(22) Filed: Aug. 31, 2012

(65) Prior Publication Data

US 2013/0055691 A1 Mar. 7, 2013

(30) Foreign Application Priority Data

Sep. 2, 2011 (KR) ..... 10-2011-0088805
Feb. 1, 2012 (KR) ..... 10-2012-0010350

(51) Int. Cl.
*B01D 50/00* (2006.01)

(52) U.S. Cl.
USPC ..... 55/337

(58) Field of Classification Search
USPC ..... 55/337, 345, 343, DIG. 3, 428, 472, 55/482, 429, 424, 426, 459.1, 467, 3, 18, 55/442–446; 15/353
See application file for complete search history.

(56) References Cited

U.S. PATENT DOCUMENTS

| | | | | |
|---|---|---|---|---|
| 7,547,351 | B2 | 6/2009 | Oh et al. | |
| 7,874,040 | B2 | 1/2011 | Follows et al. | |
| 7,966,692 | B2 | 6/2011 | Kim | |
| 2006/0016043 | A1 * | 1/2006 | Matsuhashi et al. | 15/353 |
| 2006/0123751 | A1 * | 6/2006 | Hayashi et al. | 55/428 |
| 2006/0137309 | A1 * | 6/2006 | Jeong et al. | 55/337 |
| 2006/0218744 | A1 * | 10/2006 | Hayashi et al. | 15/347 |
| 2007/0214754 | A1 | 9/2007 | Kim | |
| 2008/0092326 | A1 * | 4/2008 | Morishita | 15/352 |
| 2009/0193772 | A1 * | 8/2009 | Oh et al. | 55/343 |
| 2010/0154367 | A1 * | 6/2010 | Luo et al. | 55/337 |

FOREIGN PATENT DOCUMENTS

| | | |
|---|---|---|
| KR | 10-2006-0082900 | 7/2006 |
| KR | 10-2006-0122247 | 11/2006 |
| KR | 10-0694624 | 3/2007 |
| KR | 10-0782181 | 11/2007 |
| KR | 10-2010-0077893 | 7/2010 |

* cited by examiner

*Primary Examiner* — Dung H Bui
(74) *Attorney, Agent, or Firm* — Staas & Halsey LLP

(57) ABSTRACT

A vacuum cleaner provided with a dust separating apparatus which has an improved aesthetic quality and has an increased size without increasing the height of the vacuum cleaner. The dust-separating apparatus is easily detachable with respect to a vacuum cleaner body, and is provided with a cover that is easily detachable when dirt collected in the dust collecting compartment is discarded. The vacuum cleaner includes a first cyclone part and a second cyclone part, and a first dust collecting compartment configured to collect dirt separated from the first cyclone part is formed at a lower side of the first cyclone part and the second cyclone part.

9 Claims, 23 Drawing Sheets

720

VACUUM CLEANER AND DUST SEPARATING APPARATUS THEREOF

CROSS-REFERENCE TO RELATED APPLICATIONS

This application claims the benefit of Korean Patent Applications No. 10-2011-0088805, filed on Sep. 2, 2011 and No. 10-2012-0010350, filed on Feb. 1, 2012 in the Korean Intellectual Property Office, the disclosures of which are incorporated herein by reference.

BACKGROUND

1. Field

Embodiments of the present disclosure relate to a vacuum cleaner having a multi-cyclone dust separating apparatus.

2. Description of the Related Art

A vacuum cleaner is an apparatus designed to take in air including dirt on a surface targeted for cleaning, to separately collect the dirt from the air and to discharge purified air to an outside of a body of the vacuum cleaner.

In particular, a cyclone-type vacuum cleaner configured to separate dirt from the air using a centrifugal force is semi-permanent, and is more sanitary and convenient than a vacuum cleaner using a dust bag or a dust filter, and the cyclone-type vacuum cleaner is widely used.

In recent years, a multi-cyclone dust separating apparatus for filtering out dirt through more than two stages using a plurality of cyclones connected in a series has been developed for use. Such a multi-cyclone dust separating apparatus includes a first cyclone part configured to separate a large-size dirt and a second cyclone part configured to a small-size dirt, thereby effectively removing dirt.

Examples of the vacuum cleaner are disclosed in the U.S. Pat. No. 7,547,351 B2, US 2007/0214754 A1 and U.S. Pat. No. 7,966,692 B2. A dust-selecting apparatus of the vacuum cleaner disclosed in the above publications has a first clone part disposed at the center of a cylindrical case and a plurality of second cyclone parts disposed around the first cyclone part. A first dust collecting compartment configured to collect dust filtered out by the first cyclone part is disposed adjacent to a circumference of an inner space of the case.

In addition, the dust-separating apparatus is provided on a vacuum cleaner body so as to be detachable in a horizontal direction, and an upper surface or a lower surface of the dust separating apparatus, which is open to discard the collected dirt, is open and closed by a cover.

SUMMARY

Therefore, it is an aspect of the present disclosure to provide a vacuum cleaner having a superior stability by lowering the center of gravity, and having an improved aesthetic quality.

It is another aspect of the present disclosure to provide a vacuum cleaner having a dust-collecting compartment enlarged without increasing the height of the vacuum cleaner, and the vacuum cleaner having the same.

It is another aspect of the present disclosure to provide a vacuum cleaner having a dust-separating apparatus configured to be vertically detachable with respect to a vacuum cleaner body.

It is another aspect of the present disclosure to provide a dust-separating apparatus enabling a cover of the dust-separating apparatus to be easily detachable when dirt collected in a dust-collecting compartment is discarded.

Additional aspects of the disclosure will be set forth in part in the description which follows and, in part, will be obvious from the description, or may be learned by practice of the disclosure.

In accordance with one aspect of the present disclosure, a vacuum cleaner includes a first cyclone part and a second cyclone part that form a whirl flow approximately in a horizontal direction A first dust collecting compartment is formed at a lower side of the first cyclone part and the second cyclone part.

In addition, the vacuum cleaner may include a dust-separating apparatus accommodation part having an upper surface open. A dust-separating apparatus may be provided to be detachable with respect to the dust-separating accommodation part in an approximate vertical direction.

In addition, a grip of the dust separating apparatus may be provided at an upper side of the dust separating apparatus, and include a grip body, which is fixed to an upper surface of the dust separating apparatus, and a grip lever, which is movably coupled to the grip body and has a protrusion elastically biased while being insertedly fixed to a body of a dust separating apparatus.

In addition, the vacuum cleaner may include a front cover and a rear cover, which are detachably coupled to the body of the dust separating apparatus, and a button. The button may include a locking protrusion that protrudes upward and a pressing part provided to be exposed through a grip groove of the front cover. The button may be elastically biased such that the locking protrusion is insertedly fixed to a groove of the dust separating apparatus.

According to the embodiments of the present disclosure, the center of gravity of the vacuum cleaner is lowered, so the stability is enhanced while improving the aesthetic quality of the vacuum cleaner.

In addition, the size of the dust-collecting compartment is expanded without increasing the height of the vacuum cleaner and thus the period in emptying the dust-collecting compartment is prolonged.

In addition, the dust-separating apparatus is vertically detachable with respect to the body of the vacuum cleaner, and thus a user is easily able to detach the dust-separating apparatus from the vacuum cleaner.

In addition, a cover of the dust-separating apparatus is easily detachable from the body of the dust-separating apparatus.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
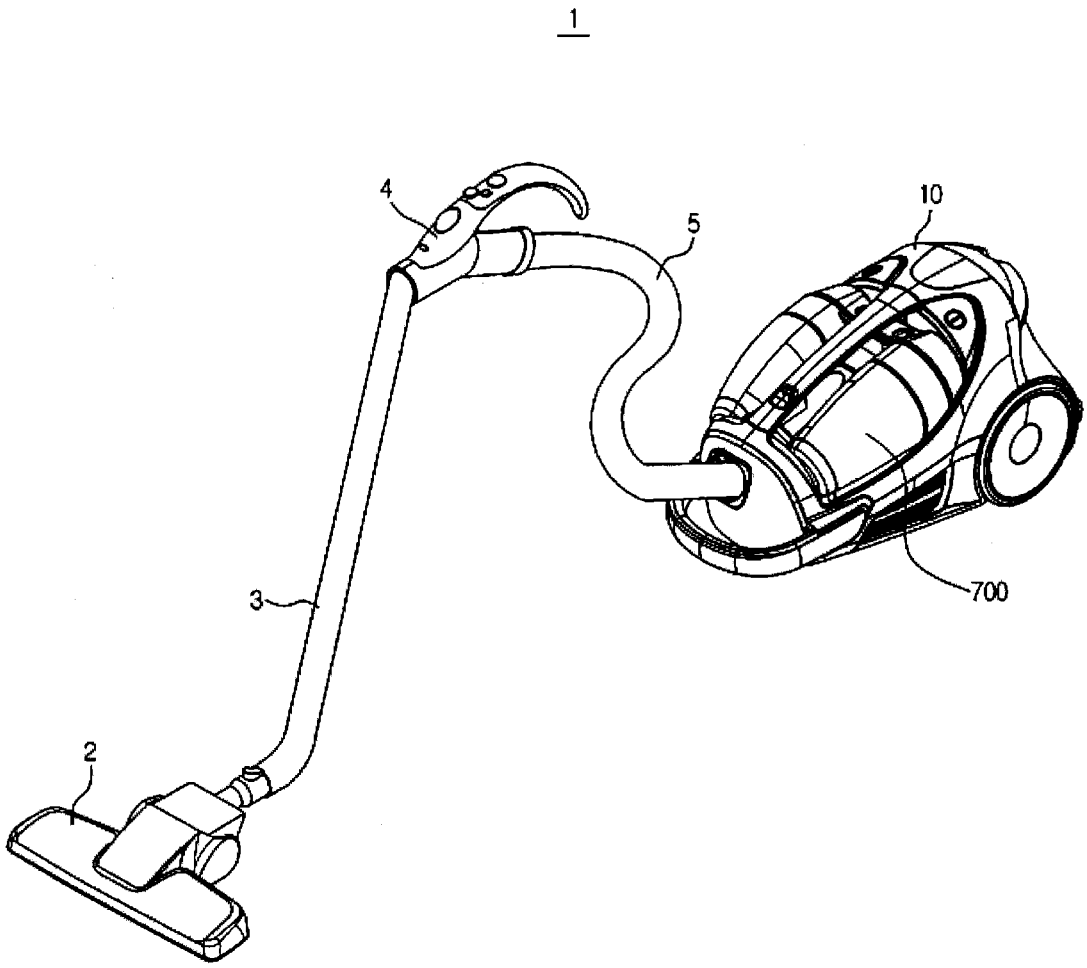
FIG. 1 is a view illustrating the exterior of a vacuum cleaner according to an embodiment of the present disclosure.
Figure 2:
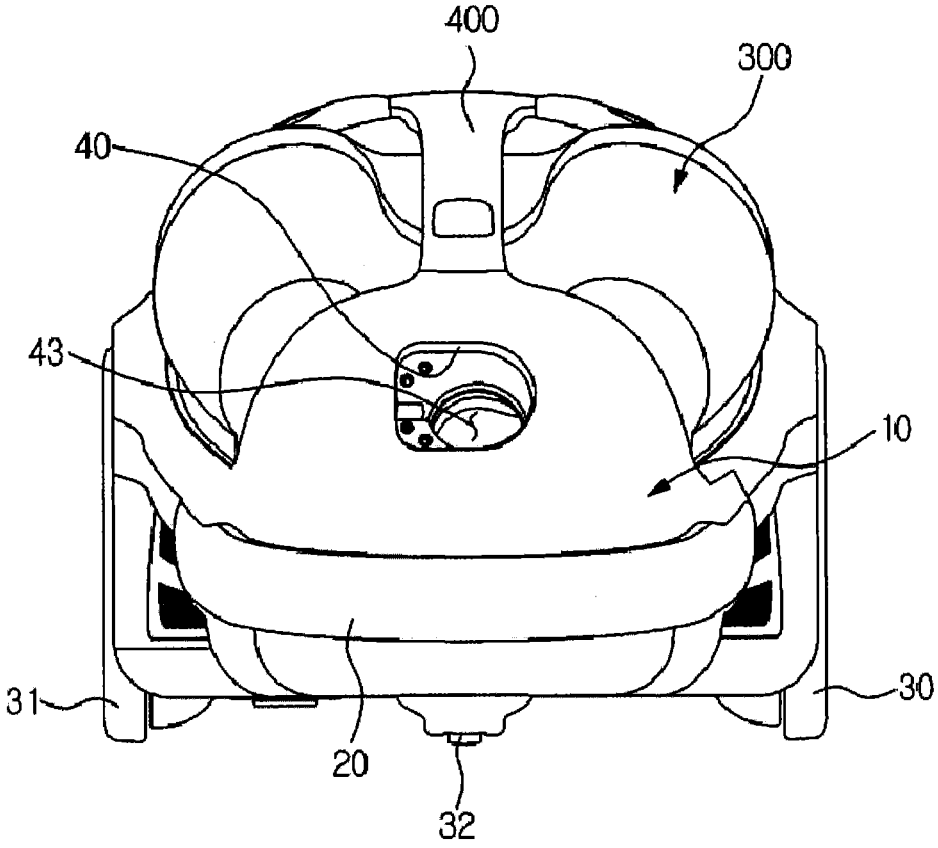
FIG. 2 is a front view illustrating the exterior of a body of the vacuum cleaner of FIG. 1.
Figure 3:
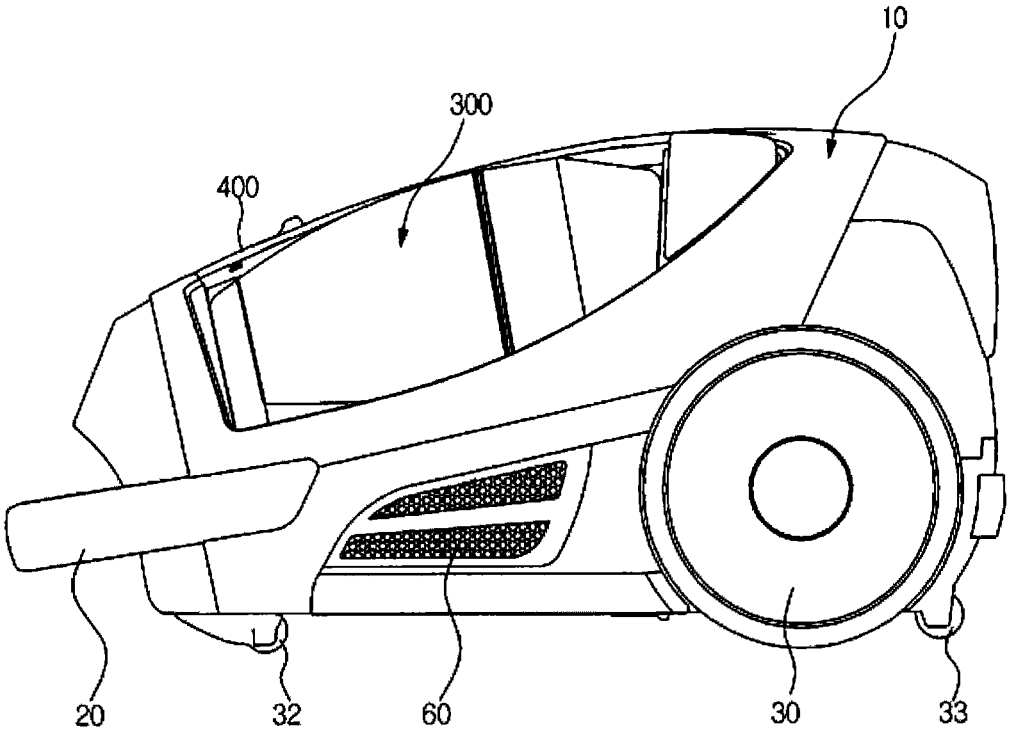
FIG. 3 is a side view illustrating the exterior of the body of the vacuum cleaner of FIG. 1.
Figure 4:
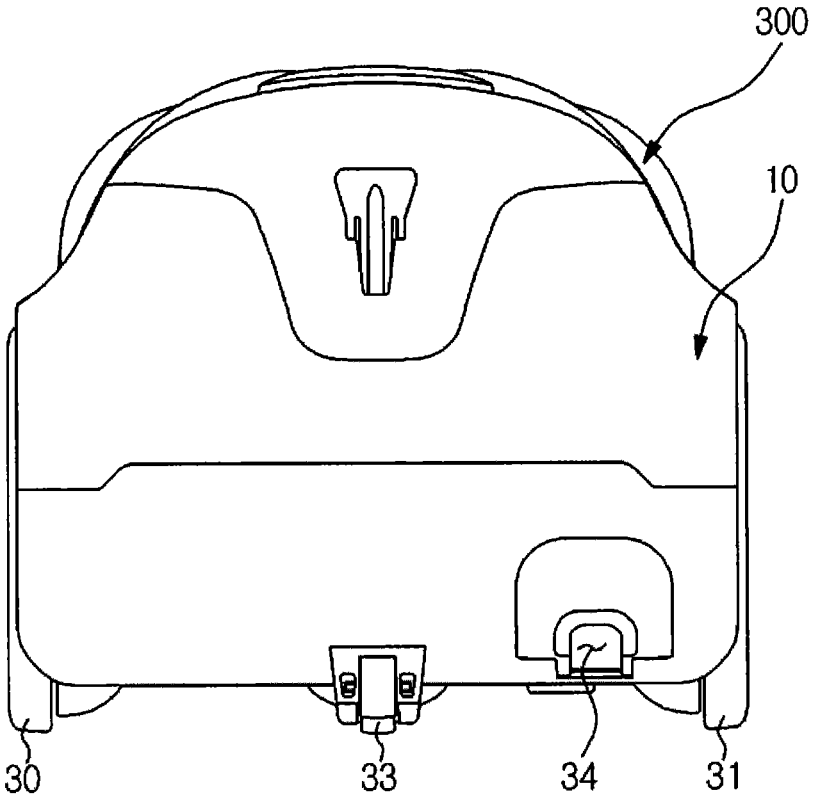
FIG. 4 is a bottom view illustrating the exterior of the body of the vacuum cleaner of FIG. 1.
Figure 5:
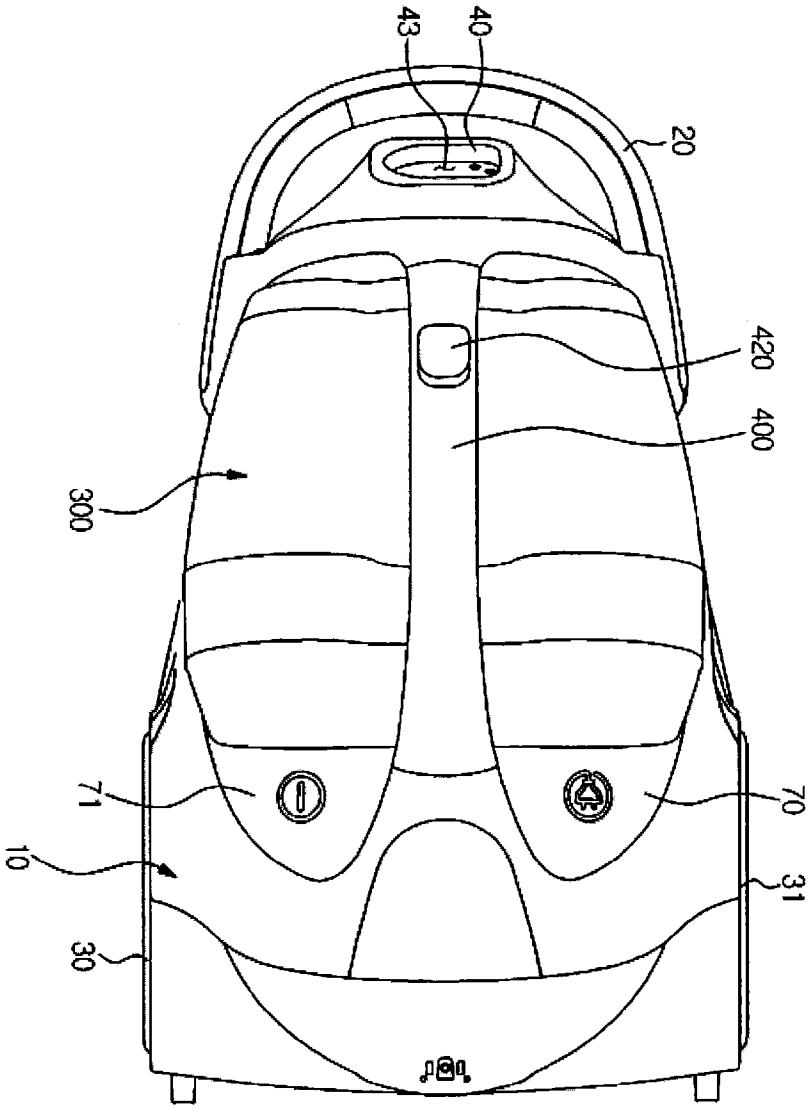
FIG. 5 is a plan view illustrating the exterior of the body of the vacuum cleaner of FIG. 1.

Reference will now be made in detail to the embodiments of the present disclosure, examples of which are illustrated in the accompanying drawings, wherein like reference numerals refer to like elements throughout.

Referring to FIGS. 1 to 5, a vacuum cleaner 1 according to one embodiment of the present disclosure includes a vacuum cleaner body 10, which is configured to generate an intake force used to take in air and to filter out dirt from the air taken in, a flexible hose 5 having one end connected to an intake port 40 of the vacuum cleaner body 10, an intake brush 2 to take in dust on a subject surface for cleaning, an extension pipe 3 having one end connected to the intake brush 2, and a manipulation part 4 having an adjusting apparatus for adjusting the intake force.

The air taken in by the intake force generated by the vacuum cleaner body 10 may contain dirt. Hereinafter, the air taken in the vacuum cleaner body 10 and containing dirt will be referred to as a dirt-containing air. The dirt-containing air taken in by the intake brush 2, after sequentially passing through the extension pipe 3 and the flexible hose 5, is taken in to the inside the vacuum cleaner body 10.

The vacuum cleaner body 10 is provided in an external appearance having a longitudinal size larger than a height, thereby having a low center of gravity. A dust-separating apparatus 300 is detachably mounted on the inside of the vacuum cleaner body 10. The dust-separating apparatus 300 is configured to separate dirt from the dirt containing air taken in the vacuum cleaner body 10 through centrifugation.

The vacuum cleaner body 10 is provided at a front surface thereof with an intake port 50 to take in the dirt-containing air, which is taken through the intake brush 2, into the inside the dust-separating apparatus 300. The intake port 40 is connected to one end of the flexible hose 5. The intake port 40 is slantingly formed on the front surface of the vacuum cleaner body 10 such that a user easily connects the flexible hose 5 to the intake port 40 without having to bend a waist or sit on a floor.

The intake port 40 serves as an entry to an inlet passage 43 which is connected to the dust-separating apparatus 300 while passing through the front portion of the vacuum cleaner body 10. Although to be described later, the dirt-containing air passing through the inlet passage 43 is guided to a guide passage (612 in FIG. 13) of the dust-separating apparatus 300.

Meanwhile, a grip 20 of the vacuum cleaner body 10 is formed on the front portion of the vacuum cleaner body 10. The grip 20 of the vacuum cleaner body 10 has both ends fixed to both sides of the vacuum cleaner body 10 while having a center that is spaced apart from the front surface of the vacuum cleaner body 10 to form a space available for gripping.

The vacuum cleaner body 10 includes wheels for movement, which include a left side wheel 30 provided at a left side surface of the vacuum cleaner body 10, a right side wheel 31 provided at a right side surface of the vacuum cleaner body 10, and a front side wheel 32 and a rear side wheel 33 that are provided on a bottom surface of the vacuum cleaner body 10 at a front side and a rear side, respectively.

The vacuum cleaner body 10 is provided at lower portions of both sides thereof with an outtake port 60. The outtake port 60 is configured to discharge air, which is purified while passing through the dust-separating apparatus 300 and a filter assembly (200 in FIG. 6), to the outside of the vacuum cleaner body 10. In addition, the vacuum cleaner body 10 is provided at a lower portion of a bottom surface thereof with a power cord passing hole 34 that passes a power cord that receives a power from an external power source.

Meanwhile, the vacuum cleaner body 10 is provided at a rear portion of an upper surface thereof with a switch part for manipulating the vacuum cleaner. The switch part includes a power switch 71 to control the supply of power and a cord reel switch 72 to manipulate the power cord reel.

The dust-separating apparatus 300 is mounted on the upper side of the vacuum cleaner body 10. The dust-separating apparatus 300 is provided at an upper surface thereof with a dust-separating apparatus grip 400. The dust-separating apparatus 300 is separated from the vacuum cleaner body 10 by operating a grip lever 420 provided on the dust-separating apparatus grip 400.

Figure 6:
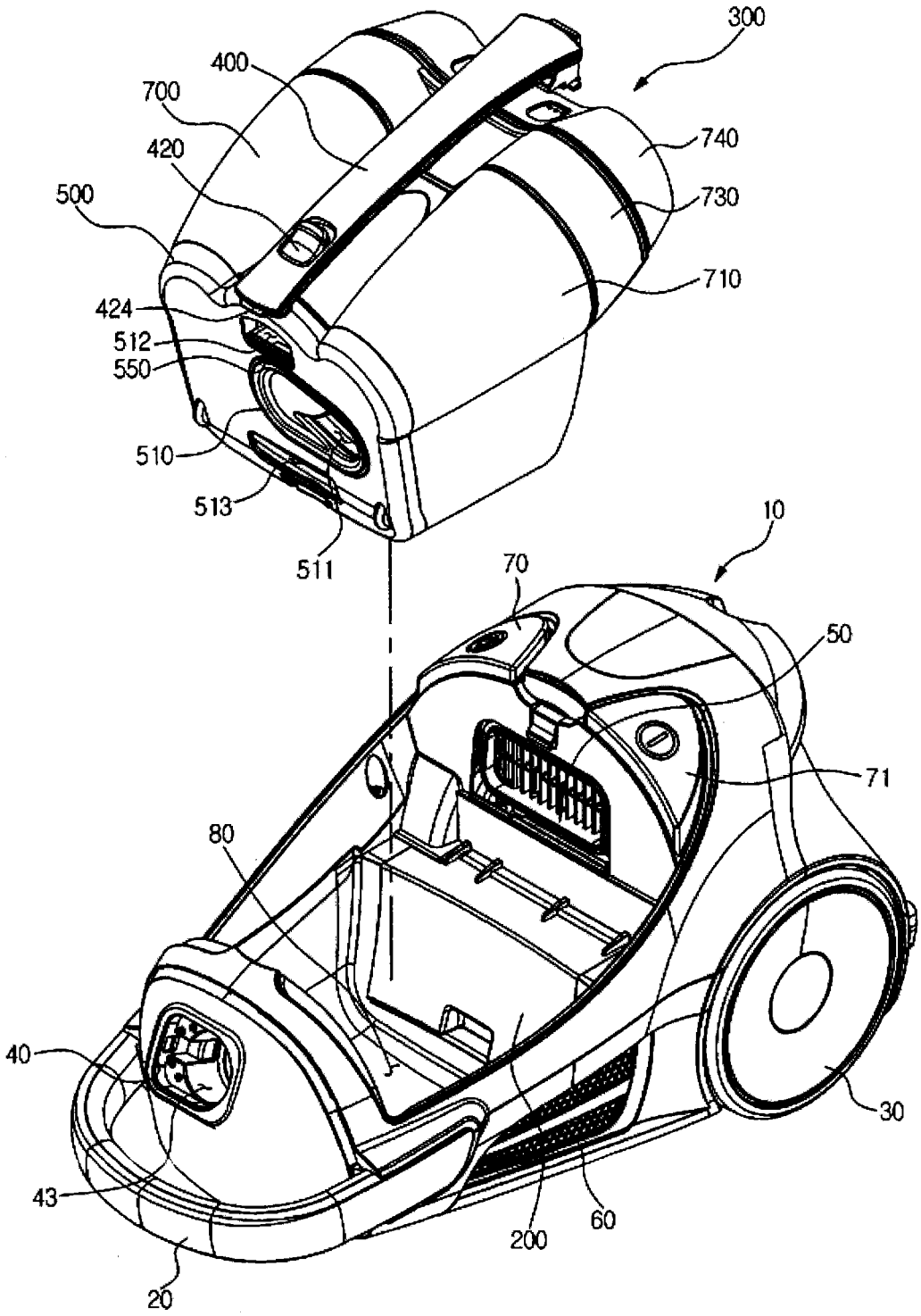
FIG. 6 is a view illustrating a state of a dust-separating apparatus which is separated from the vacuum cleaner of FIG. 1.
Figure 7:
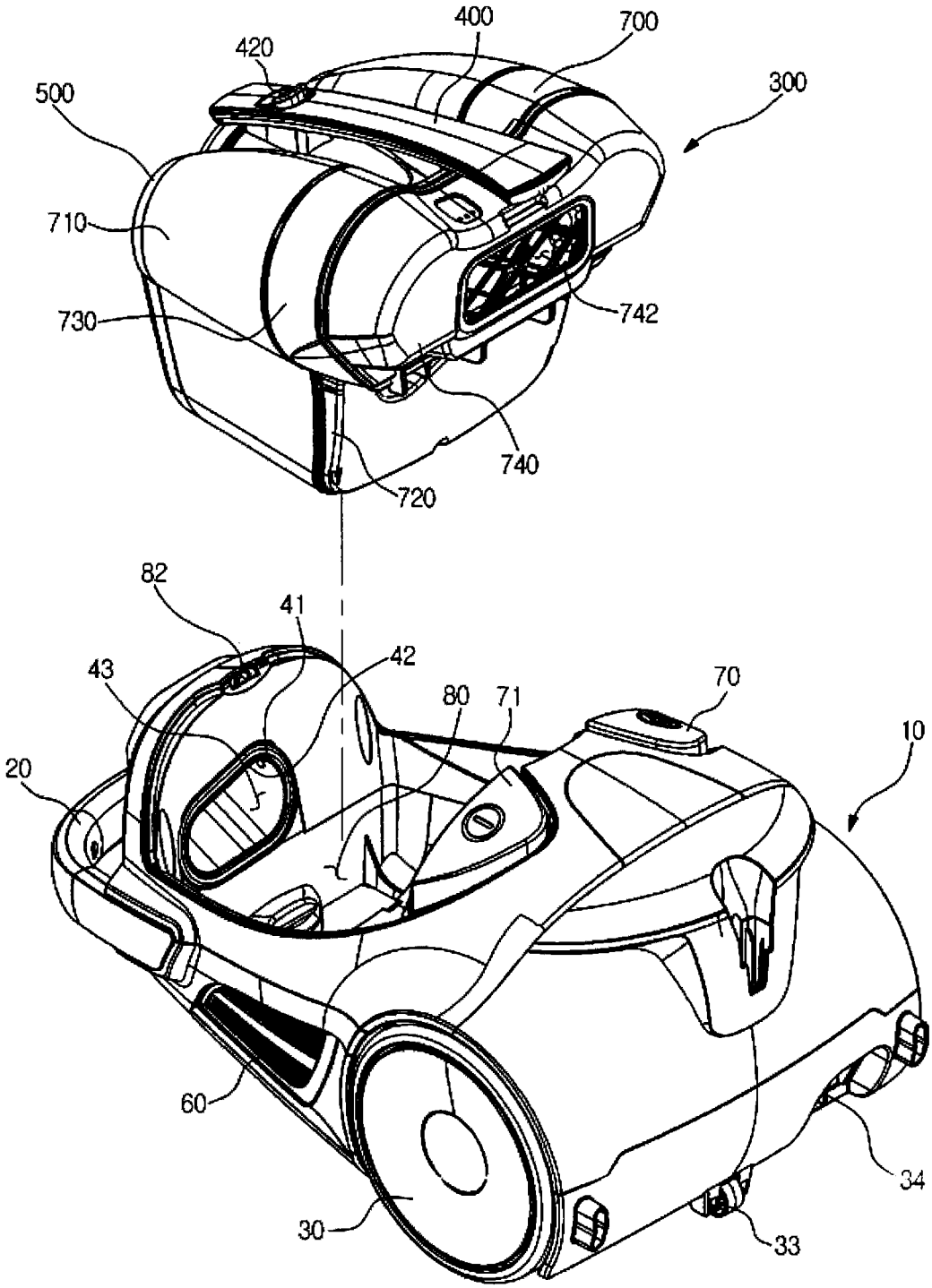
FIG. 7 is a view illustrating a state of the dust-separating apparatus, which is separated from the vacuum cleaner of FIG. 1, viewed at a different angle from the perspective of FIG. 6.
Figure 8:
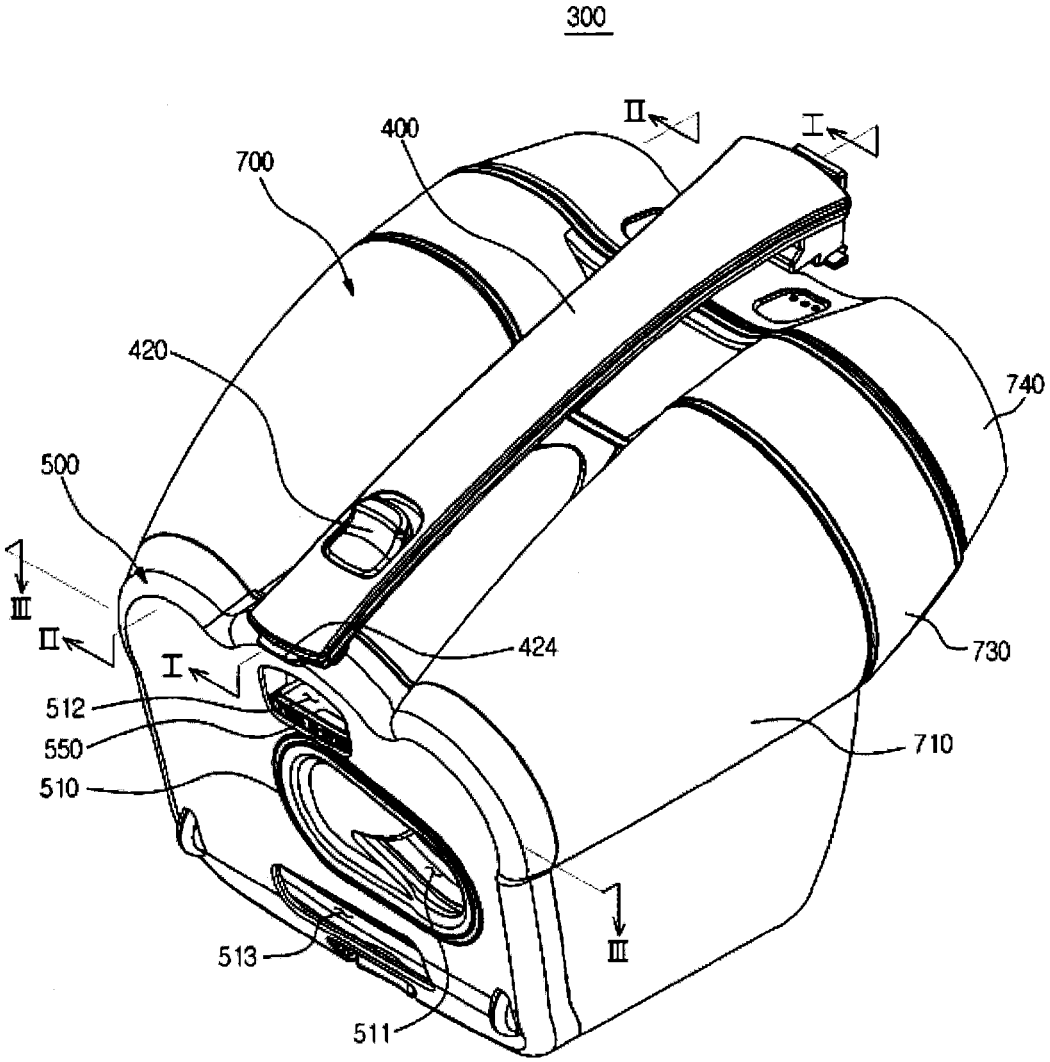
FIG. 8 is a perspective view illustrating the exterior of the dust-separating apparatus of the vacuum cleaner of FIG. 1.
Figure 9:
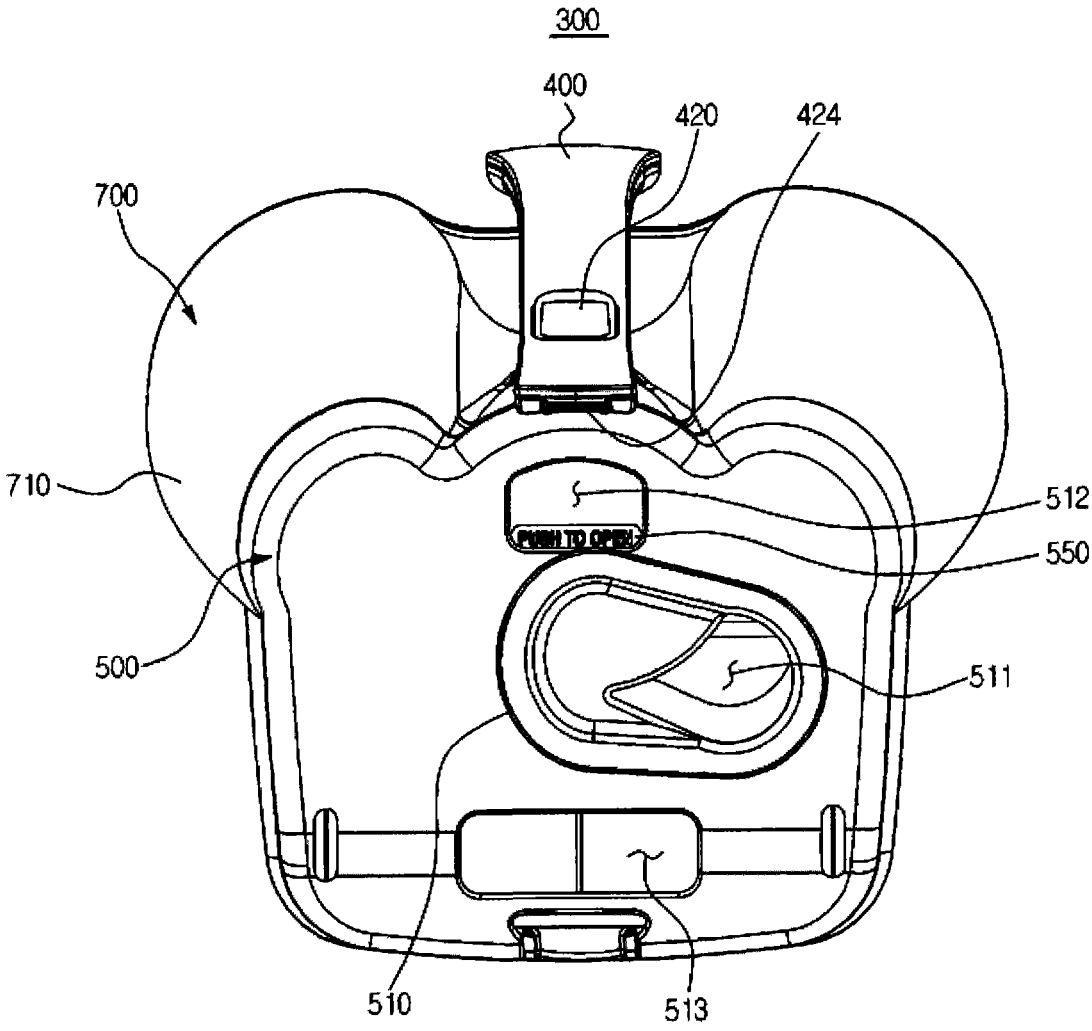
FIG. 9 is a front view illustrating the exterior of the dust-separating apparatus of the vacuum cleaner of FIG. 1.
Figure 10:
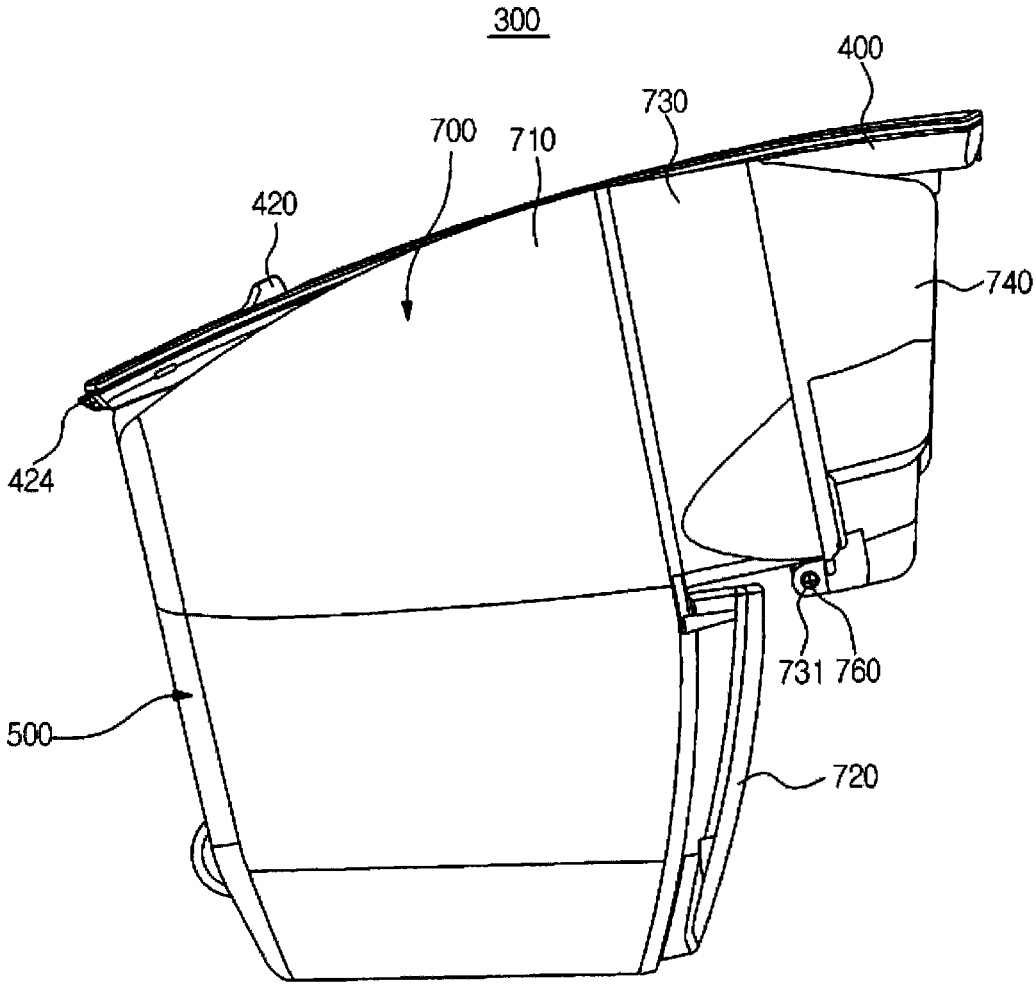
FIG. 10 is a side view illustrating the exterior of the dust-separating apparatus of the vacuum cleaner of FIG. 1.
Figure 11:
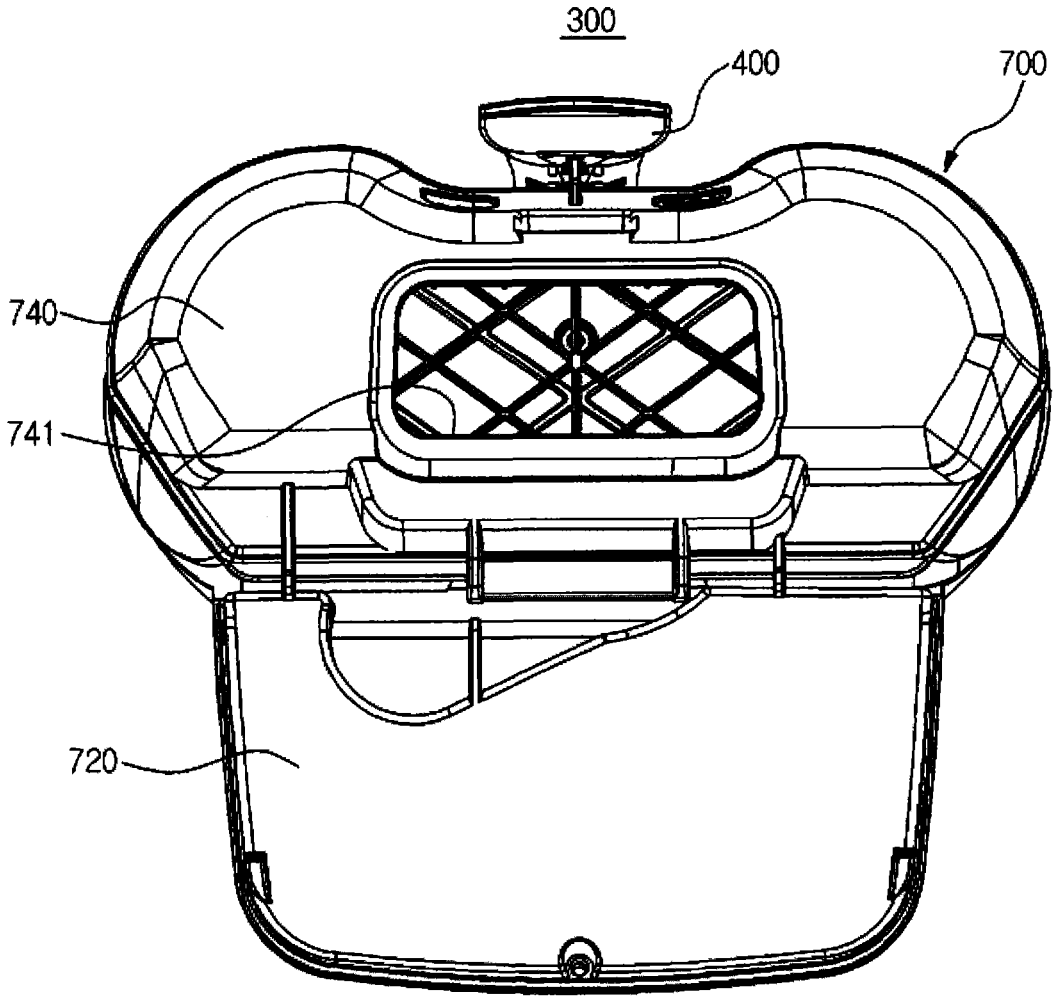
FIG. 11 is a bottom view illustrating the exterior of the dust-separating apparatus of the vacuum cleaner of FIG. 1.
Figure 22:
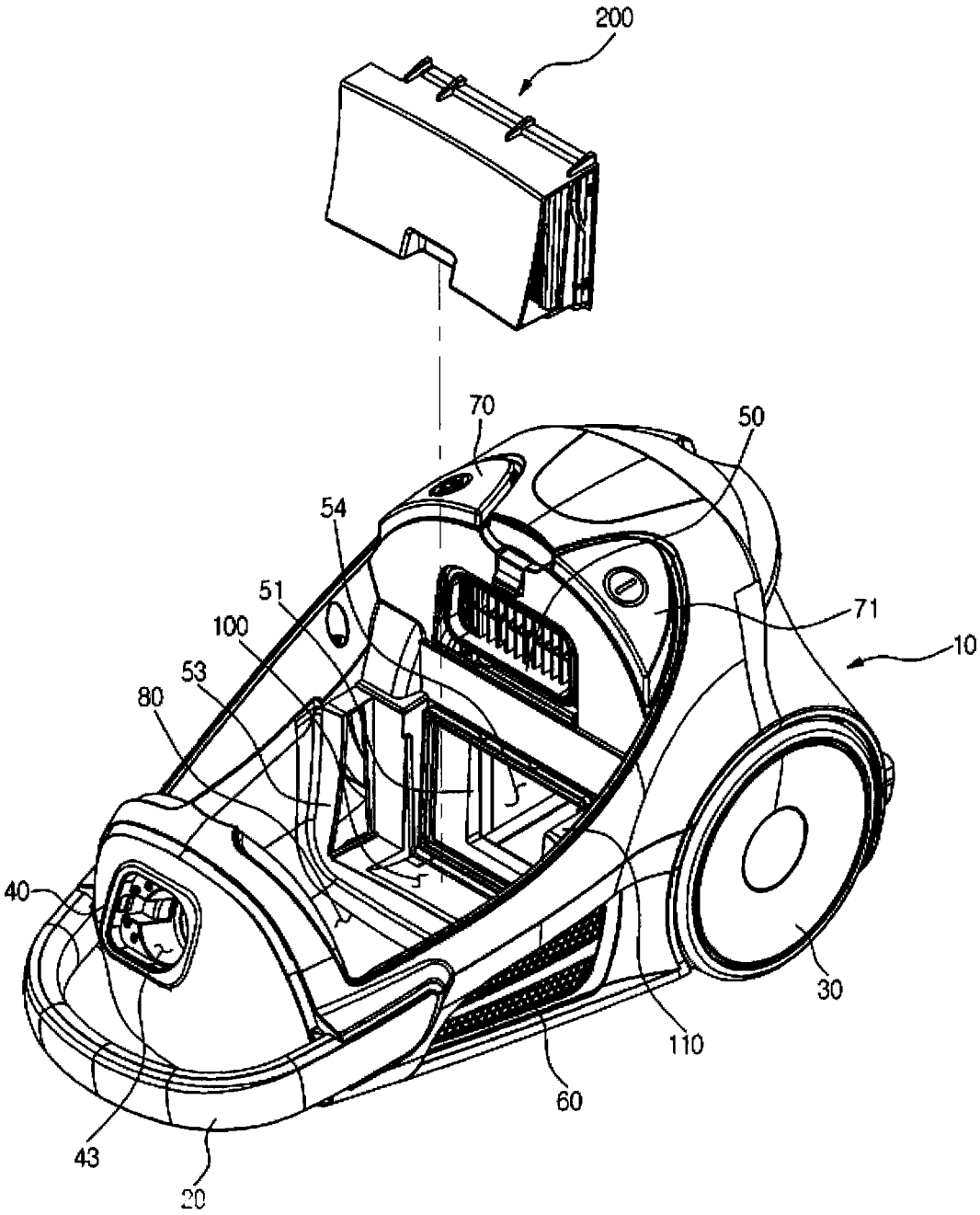
FIG. 22 is a view illustrating a state of the body of the vacuum cleaner of FIG. 12 from which a filter assembly is separated.

FIG. 6 is a view illustrating a state of a dust-separating apparatus which is separated from the vacuum cleaner of FIG. 1. FIG. 7 is a view illustrating a state of the dust-separating apparatus, which is separated from the vacuum cleaner of FIG. 1, viewed at a different angle from the perspective of FIG. 6. FIG. 22 is a view illustrating a state of the body of the vacuum cleaner of FIG. 12 from which a filter assembly is separated.

Referring to FIGS. 6 and 7, a dust-separating apparatus accommodation part 80 having an upper surface open is provided on the vacuum cleaner body 10. An exit 41 of the inlet passage 43 is formed on a front surface of the dust-separating apparatus accommodating part 80 such that the dirt-containing air taken in through the inlet passage 43 is introduced into the dust-separating apparatus 30 accommodated in the dust-separating apparatus accommodation part 80.

An inlet passage gasket 42 is installed around the exit 41 of the inlet passage 43 for air tightness. A gasket-mounting part 510 having a shape corresponding to that of the exit 41 of the inlet passage 43 is formed on the front surface of the dust-separating apparatus 300 such that the dirt-containing air taken in through the inlet passage 43 is introduced to the inside of the dust-separating apparatus 300 while being prevented from being leaked.

A fan motor compartment (54 in FIG. 22) on which a fan motor assembly (110 in FIG. 22) configured to generate an intake force is disposed at a rear side of the dust-separating apparatus accommodation part 80. A fan motor compartment entry 50 is formed at an upper portion of the rear side of the dust-separating apparatus accommodation part 80 such that the air purified through the dust-separating apparatus 300 is introduced to the fan motor compartment 54 through the fan motor compartment entry 50.

The filter assembly 200 is provided between the dust-separating apparatus accommodation part 80 and the fan motor compartment 54 such that air passing through the fan motor 54 is finally filtered out before being exhausted to the outside the vacuum cleaner 1 through outtake port 60.

In addition, a locking groove 82 is formed in an upper portion of a front surface of the dust-separating apparatus accommodation part 80 to fix the dust-separating apparatus 300 accommodated in the dust-separating apparatus accommodation part 80. The dust-separating apparatus 300 includes a lever protrusion 424 used to fix the dust-separating apparatus 300 to the vacuum cleaner body 10. The lever protrusion 424 may be inserted into the locking groove 82.

As described above, the dust-separating apparatus accommodation part 80 is configured to have an upper surface that may be open. Accordingly, the dust-separating apparatus 300 is installed on the dust-separating apparatus accommodation part 80 from an upper side to a down side in an approximately vertical direction. In addition, the dust-separating apparatus 300 is separated from the dust-separating apparatus accommodation part 80 in an approximately vertical direction.

Accordingly, as compared to a conventional vacuum cleaner having a dust-separating apparatus detachable in an approximately horizontal direction or an inclined direction, the vacuum cleaner according to the embodiment of the present disclosure enables the dust-separating apparatus 300 to be easily detached.

Referring to FIGS. 8 to 13, the dust separating apparatus 300 of the vacuum cleaner according to the embodiment of the present disclosure includes a dust-separating apparatus body 700 and a cover 500 detachably coupled to the dust-separating apparatus body 700 to open/close a front surface of the dust-separating apparatus body 700. The dust-separating apparatus body 700 includes an outer case 710 forming the external appearance of the dust-separating apparatus 300, an inner case 720 coupled to a rear surface of the outer case 710 while having one portion disposed inside the outer case 710, and a rear case 730 coupled to a rear surface of the inner case 720.

The outer case 710 is provided at an upper surface thereof with the dust-separating apparatus grip 400 including a grip body 430, the grip lever 420, and a grip cap 410. The grip body 430 is fixedly coupled to the upper surface of the outer case 710 through a fastening member.

The grip body 430 includes a groove 432 into which a locking protrusion 558 of the cover 500, which is to be described later, is inserted and an elastic member support part 431 that is protruded upward to be accommodated in an opening 422 of the grip lever 420. As the locking protrusion 558 of the cover 500 is inserted into the groove 432 of the grip body 430, the cover 500 is fixed to the dust-separating apparatus body 700.

The grip lever 420 is provided at an upper side of the grip body 430 so as to enable a forward and backward motion with respect to the grip body 430. In addition, the grip lever 420 includes the opening 422 to accommodate the elastic member support part 431, an elastic member installation part 421 enabling an elastic member to be installed in the opening 422 and the lever protrusion 424 that is inserted into the locking groove (82 in FIG. 7) of the dust-separating apparatus accommodation part. The dust-separating apparatus 300 is fixed to the vacuum cleaner body 10 as the lever protrusion 424 is inserted into the locking groove 82.

The lever protrusion 424 is protruded forward at a front end of the grip lever 420. In addition, the grip lever 420 may further include a pushing-in part 423 that is protruded upward to be pressed by an outside.

The grip cap 410 is coupled to an upper side of the grip lever 420 to cover the grip lever 420. The grip cap 410 includes a grip cap opening 411 that is provided at a position corresponding to the pushing-in part 423 such that the pushing-in part 423 is protruded upward beyond the grip cap 410.

Through the above configuration, the grip lever 420 is subject to an elastic-biased state by an elastic member (not shown) installed in the elastic member installation part 421 at usual times such that the lever protrusion 424 is locked while being inserted into the locking groove 82 and the dust-separating apparatus 300 accommodated in the dust-separating apparatus accommodation part is fixed to the vacuum cleaner body 10.

If a user moves the grip lever 420 while pushing the pushing-in part 423 in a direction that the lever protrusion 424 is separated from the locking groove 82, the dust-separating apparatus 300 is separated from the dust-separating apparatus accommodation part 80, that is, from the vacuum cleaner body 10.

In addition, since the pushing-in part 423 is disposed approximately at a front side of the dust-separating apparatus grip 400, a user easily operates the pushing-in part 423 using a thumb in a state of grasping approximately a center part of the dust-separating apparatus grip 400. Accordingly, the user releases the locking by operating the pushing-in part 423 in a state of grasping the dust-separating apparatus grip 400 with a hand, and then lifts the dust-separating apparatus 300 upward, thereby easily separating the dust-separating apparatus 300 from the vacuum cleaner body 10.

Meanwhile, the outer case 710 includes an outer wall 600 and an inner wall 601. The outer wall 600 forms the external appearance of the outer case 710, and has a front surface and a rear surface that are to be open. The inner wall 601 is provided inside the outer wall 600 to divide the inside the outer wall 600 into a first cyclone part 613, a first dust-collecting apparatus 614 to collect dirt separated from the first cyclone part 613, second dust collecting compartments 615 and 616 to collect dirt separated from a second cyclone part 640, and a guide passage 612 allowing air taken from the outside to pass therethrough to the first cyclone part 613.

The outer case 710 is formed as an integral body through injection of resin. In addition, the outer case 710 is formed using transparent or semi-transparent material allowing the interior of the outer case 710 to be seen through. The front surface of the outer case 710 open may be closed by the cover 500.

Meanwhile, the inner case 720 is coupled to the rear surface of the outer case 710 to close the rear surface of the outer case 710 that is open. The inner case 720 is inserted into the inside the outer case 710 such that the second dust collecting compartments 615 and 616 are formed around the inner case 720. The inner case 720 includes a plurality of second cyclone pipes 641 each having the second cyclone part 640 therein.

For example, the second cyclone pipe 641 according to the embodiment of the present disclosure is provided in six of the second cyclone forming pipes. The number of second cyclone pipes 641 is only used as an example and is meant to be non-limiting as to the number of possible second cyclone pipes 641 used. The second cyclone pipe 641 is provided in a conical shape to have a diameter getting decreased from a rear side to a front side of the second clone pipe 641. A front surface and a rear surface of the second cyclone pipe 641 are configured to be open.

The second cyclone part 640 generates a swirl flow to secondarily centrifugate dirt contained in air (hereinafter, referred to as a first purified air) purified by passing through the first cyclone part 613. The separated dirt is collected by the second dust-collecting compartments 615 and 616 through the front surface of the second cyclone pipe 641 that is open.

In addition, the inner case 720 further includes a partition part 722 and a distribution part 721 provided at an upper side of the partition part 722. The partition part 722 is configured to close the rear surface of the outer case 710 to form the first dust-collecting compartment 614. The distribution duct 721 has a distribution passage 630 configured to distribute the first purified air passing through the first cyclone part 613 into the plurality of second cyclone parts 640 while forming the second dust-collecting compartments 615 and 616. The inner case 720 is formed as an integral body through injection of resin.

The rear case 730 is coupled to the rear surface of the inner case 720 to close a rear surface of the distribution passage 630 that is open. The rear case 730 includes a plurality of second purified air exhaust pipes 650 that are inserted into the rear surfaces of the second cyclone pipes 641, respectively, of the inner case 720.

An outer surface of the second purified air exhaust pipe 650 forms the second cyclone part 640 in cooperation with an inner surface of the second cyclone pipe 641. An air (hereinafter, referred to as second purified air) purified by the second cyclone part 640 is exhausted to the outside by passing through the second purified air exhaust pipe 650. The rear case 730 is formed as an integral body through injection of resin.

Meanwhile, the dust separating apparatus 400 may further include a pair of decoration covers 670 and 680 that are coupled to the front side of the inner case 720. The decoration covers 670 and 680 include front surface walls 671 and 681 forming the second dust-collecting compartments 615 and 616, through holes 673 and 683 allowing the second cyclone pipes 641 to pass therethrough, and decoration grilles 672 and 682 coupled to outer circumferential surfaces of the second cyclone pipes 641.

In addition, the dust-separating apparatus 300 may further include a spongy accommodation part 740 coupled to the rear surface of the rear case 730 and a cover 500 coupled to the front surface of the outer case 730.

The spongy accommodation part 740 is provided at a lower side thereof with hinge holes 760 and 770. The spongy accommodation part 740 is coupled to the rear case 730 as a hinge shaft (731 in FIG. 10) provided at a lower side of the rear case 730 is inserted into the hinge holes 760 and 770.

The spongy accommodation part 740 is configured to accommodate a sponge case 750, which is configured to accommodate a spongy (not shown) to filter out dirt contained in the air. The spongy accommodation part 740 has a front surface and a rear surface 742 that are able to be open, and the rear surface 742 of the spongy accommodation part 740 represents a dust-separating apparatus outlet 742 through which air is finally exhausted to the outside of the dust-separating apparatus 300.

Accordingly, the second purified air exhausted through the plurality of second purified air exhaust pipes 650 of the rear case 730, after being secondarily filtered through the spongy (not shown), is discharged through the dust-separating apparatus outlet 742 to the outside the dust-separating apparatus 300.

The sponge accommodation part 740 is provided at an inside with a second purified air joining space (661 in FIGS. 15 and 16) in which the second purified air passing through the plurality of second purified air exhaust pipes 650 joins.

The spongy accommodation part 740 to accommodate the spongy (not shown) is rotatably open with respect to the hinge shaft 731 at a lower side of the rear case 730, thereby easily cleaning and replacing the spongy (not shown) accommodated in the spongy accommodation part 740. The spongy accommodation part 740 is formed as an integral body through injection of resin.

Meanwhile, the cover 500 is coupled to the outer case 710 of the dust-separating apparatus body 700 to open/close the surface of the dust-separating apparatus body 700 that is open. The cover 500 includes a front cover 501, a button 550, and a rear cover 502.

Center areas of the front cover 501 and the second cover 502, which correspond to each other, are open to form a dust-separating apparatus inlet 511 through which air is introduced into the inside the dust-separating apparatus body 700. The dust-separating apparatus inlet 511 is provided at a position corresponding to the guide passage 612 such that the dirt-containing air taken through the inlet passage (43 in FIG. 7) of the vacuum cleaner body (10 in FIG. 7) is introduced to the guide passage 612.

In addition, the front cover 501 includes an upper grip groove 512 and a lower grip groove 513 that are provided at an upper side and a lower side, respectively, of the dust-separating apparatus inlet 511. The upper grip groove 512 and the lower grip groove 513 are configured such that a user, while griping the upper and lower grip grooves 512 and 513, holds and separates the cover 500 from the dust-separating apparatus 700. For example, a user may hold the cover 500 by inserting the thumb into the upper grip groove 512 while inserting the remaining into the lower grip groove 513, separating the cover 500 from the dust-separating apparatus body 700.

The button 550 is provided between the front cover 501 and the rear cover 502 to lock or unlock the cover 500 to the dust-separating apparatus body 700.

Figure 20:
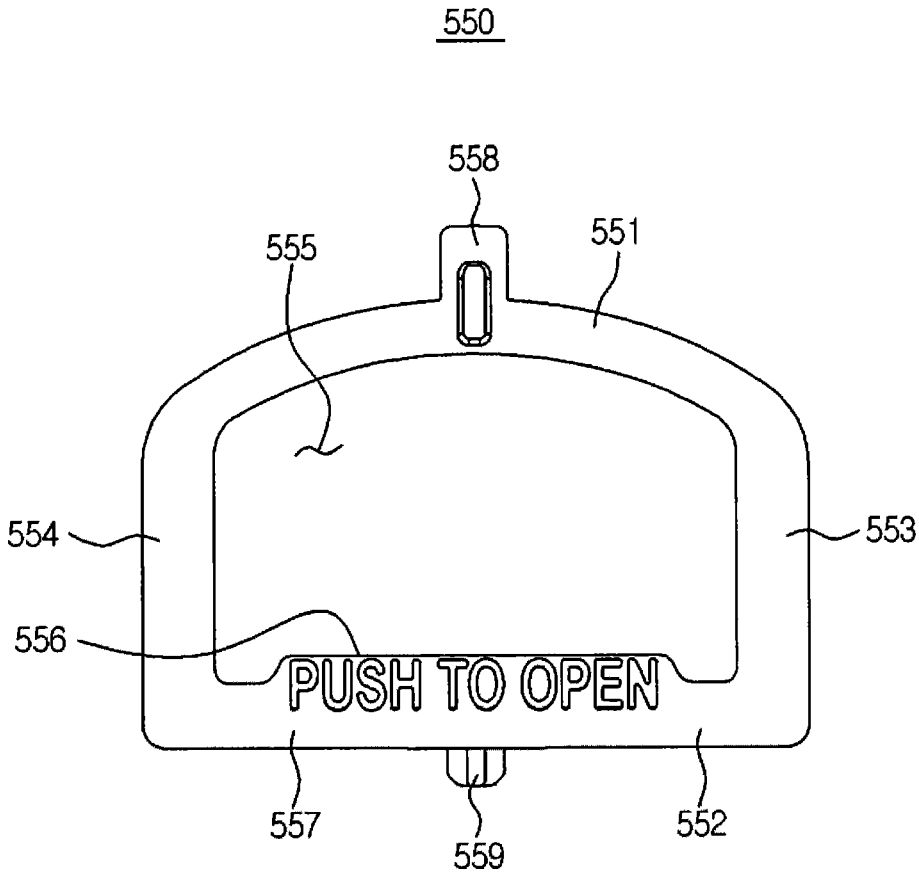
FIG. 20 is a view illustrating a button of the vacuum cleaner of FIG. 12.

Referring to FIG. 20, the button 550 is provided in an approximate ring shape, and has a button opening 555 at a center thereof. An upper rim part 551, a left rim part 553, a lower rim part 552, and a right rim part 554 are provided around the button opening 555 while being integrally formed with one another.

The locking protrusion 558 protrudes at an upper side of the upper rim part 551, and an elastic member installation part 559 is formed at a lower side of the lower rim part 552. In addition, the lower rim part 552 is provided at an upper side with a display part 557 on which an instruction is written. In addition, a pressing part 556 is provided at an upper side of the display part 556.

Figure 21:
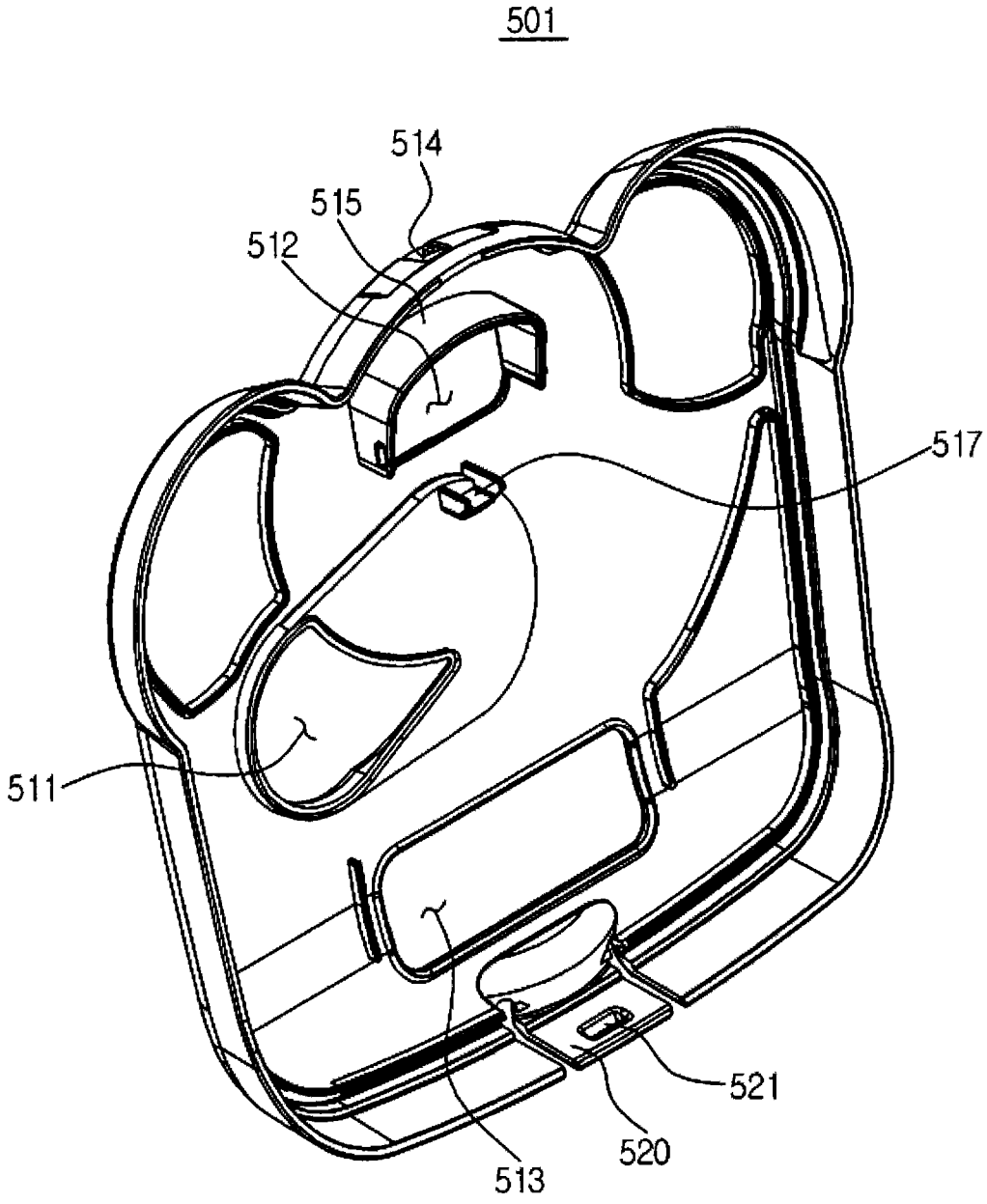
FIG. 21 is a view illustrating a bottom surface of a front cover of the vacuum cleaner of FIG. 12.

Referring to FIG. 21, the button 550 is installed to be elastically supported by the elastic member at the rear surface of the front cover 501. The front cover 501 includes a button guide part 515, a button support part 517, and a button through hole 514. The button guide part 515 protrudes from the rear surface of the front cover 501 while being inserted into the button opening 555 of the button 550 to guide the button 550. The elastic member support part 517 protrudes at a lower side of the button guide part 515. The button through hole is formed at an upper end of the front cover 501 such that the locking protrusion 558 passes through the button through hole.

Figure 12:
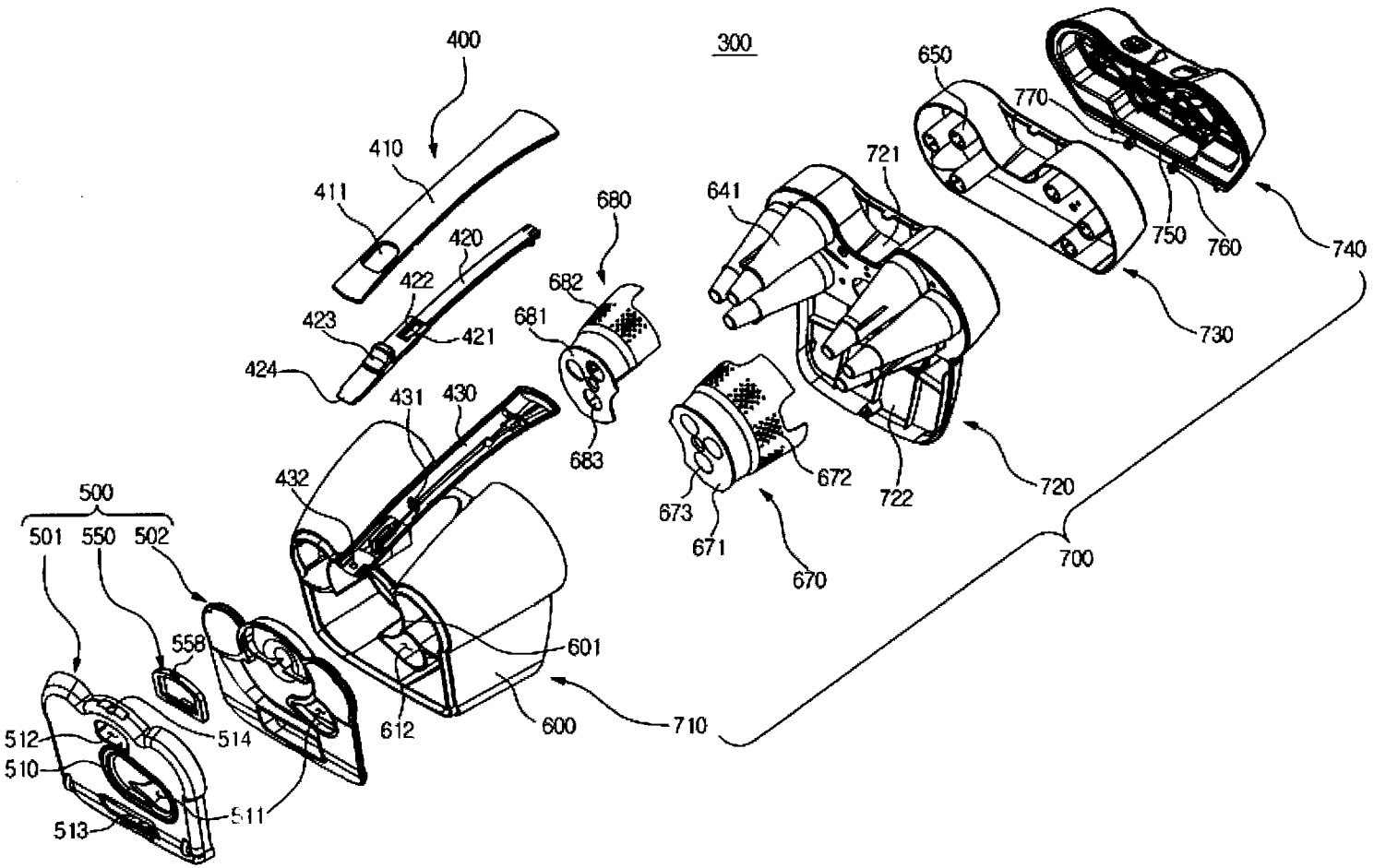
FIG. 12 is an exploded perspective view illustrating components of the dust-separating apparatus of the vacuum cleaner of FIG. 1.

The button 550 is elastically supported by the elastic member (not shown) so that the locking protrusion 558 passing through the button through hole 514, after protruding upward, is locked with the groove (432 in FIG. 12). Accordingly, the cover 500 is fixed to the dust separating apparatus body 700.

Meanwhile, the front cover 501 further includes an elastic part 520 and a catching groove 521. The elastic part 520 is formed at a lower end of the front cover 501 so as to enable a predetermined elastic deformation. The catching groove 521 is formed while passing through the elastic part 520. A catching groove (711 in FIG. 13) protrudes from a lower end of the outer case 710 such that the catching groove is inserted into the catching groove 521. As the catching protrusion 711 is inserted into the catching groove 521, the lower end of the cover 500 is fixed to the lower end of the dust-separating apparatus body 700 at usual times.

Figure 19:
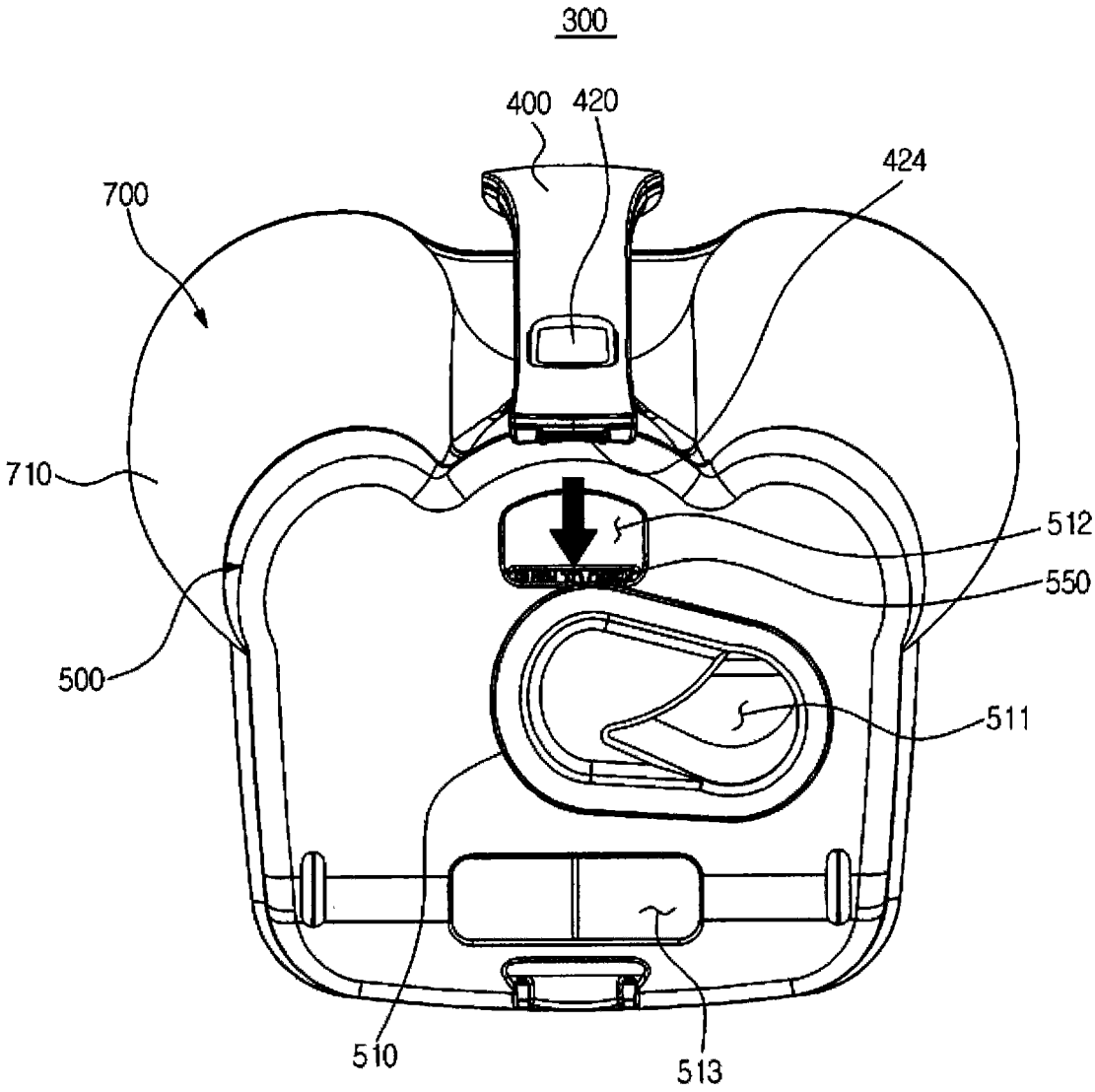
FIG. 19 is a view illustrating a process of separating the cover from the dust-separating apparatus of the vacuum cleaner of FIG. 1.

Referring to FIG. 19, if the pressing part 556 of the button 550 is pressed downward, the locking protrusion 558 is released from the groove (432 in FIG. 12) and thus the upper end of the cover 500 is separated from the dust-separating apparatus body 700. At this time, as the cover 500 is slightly moved downward to release the catching protrusion 711 from the catching groove 521, the cover 500 may be separated from the dust separating apparatus body 700.

As described above, the vacuum cleaner 1 according to the embodiment of the present disclosure has the upper grip groove 512 and the lower grip groove 513 at the cover 500 so as to facilitate the gripping. In addition, the button 550 having the pressing part 556 protruding at the lower portion of the upper grip groove 521 is installed so that a user easily separates the cover 500 from the vacuum cleaner body 700 only through a motion of inserting the fingers into the upper grip groove 521 and the lower grip groove 513 to hold the cover 500 and then pulling the cover 500 from the vacuum cleaner body 700.

Hereinafter, the structures of the first cyclone part 613, the second cyclone part 640, the first dust-collecting compartment 614 and the second dust-collecting compartments 615 and 616 will be described.

Figure 13:
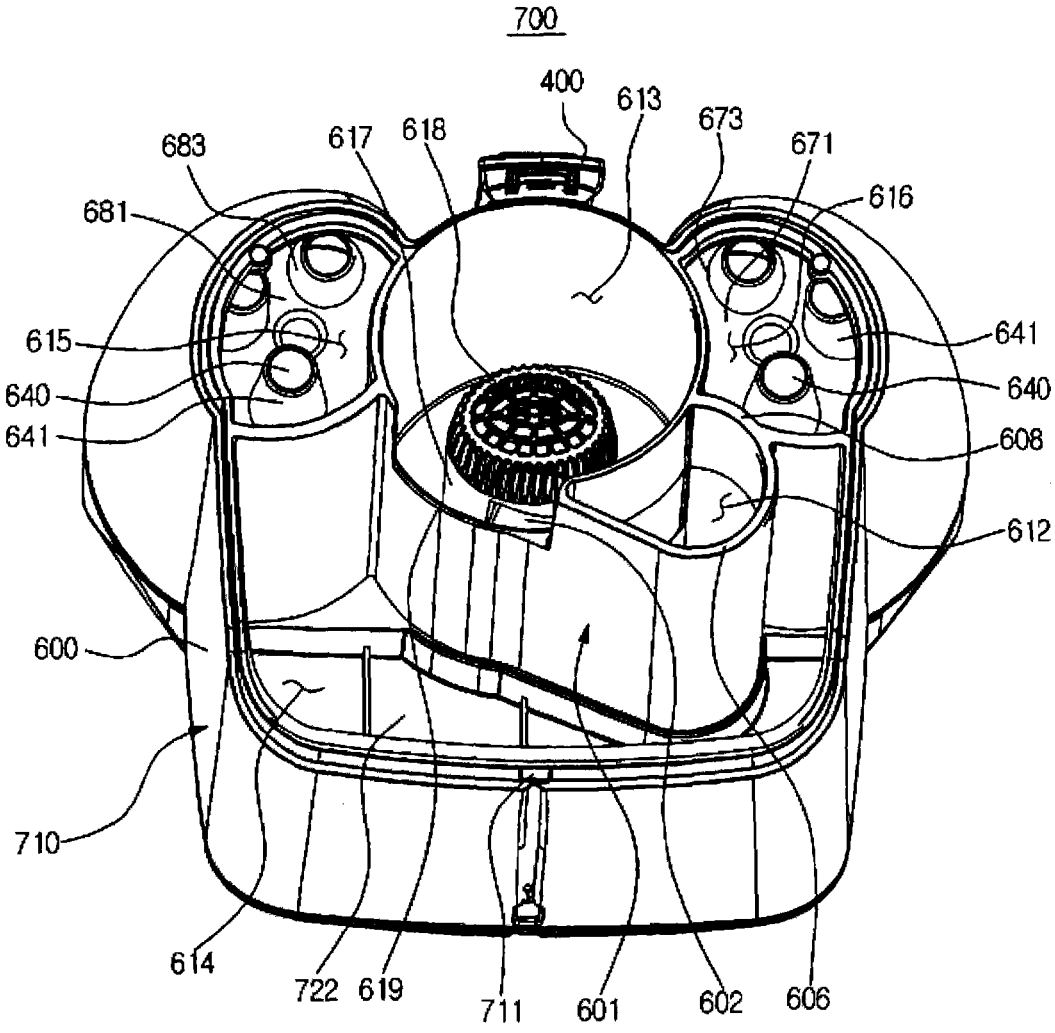
FIG. 13 is a view illustrating an interior of the dust-separating apparatus when separating a cover from the dust-separating apparatus of the vacuum cleaner of FIG. 1.

Referring to FIG. 13, the first cyclone part 613 to firstly centrifugate a relatively large dirt from the dirt-containing air is provided at a upper middle portion of the outer case 710. In addition, the second dust-collecting compartments 615 and 616 are provided at both sides of the first cyclone part 613, and the first dust-collecting compartment 614 is provided at a lower portion of the outer case 710.

The inner space formed by the outer wall 600 of the outer case 701 is divided into the first cyclone part 613, the first dust-collecting compartment 614, the second dust-collecting compartments 615 and 616, and the guide passage 612 by the inner wall 601. The guide passage 612 is disposed at a side of a lower portion of the inner space formed by the outer wall 600.

Figure 14:
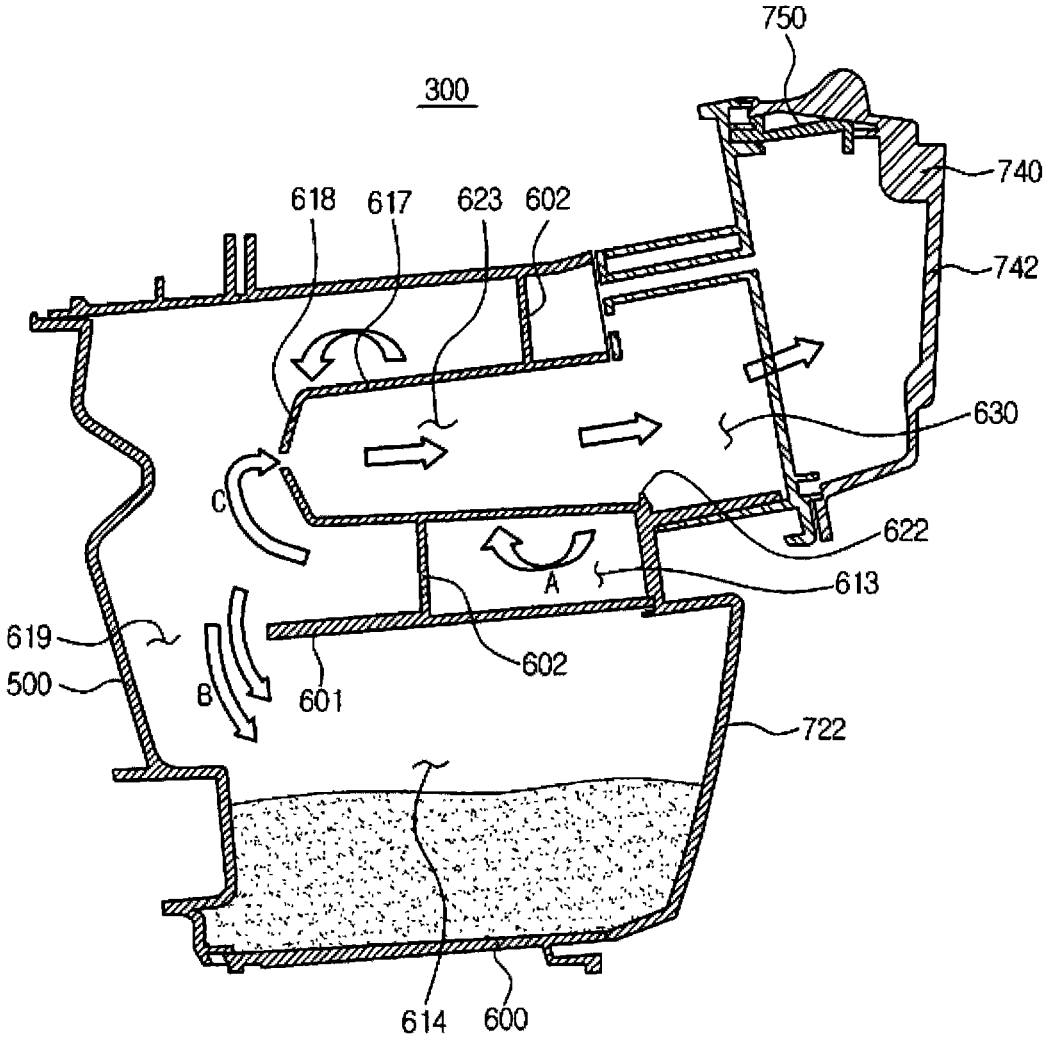
FIG. 14 is a cross-sectional view taken along line I-I of FIG. 8.
Figure 16:
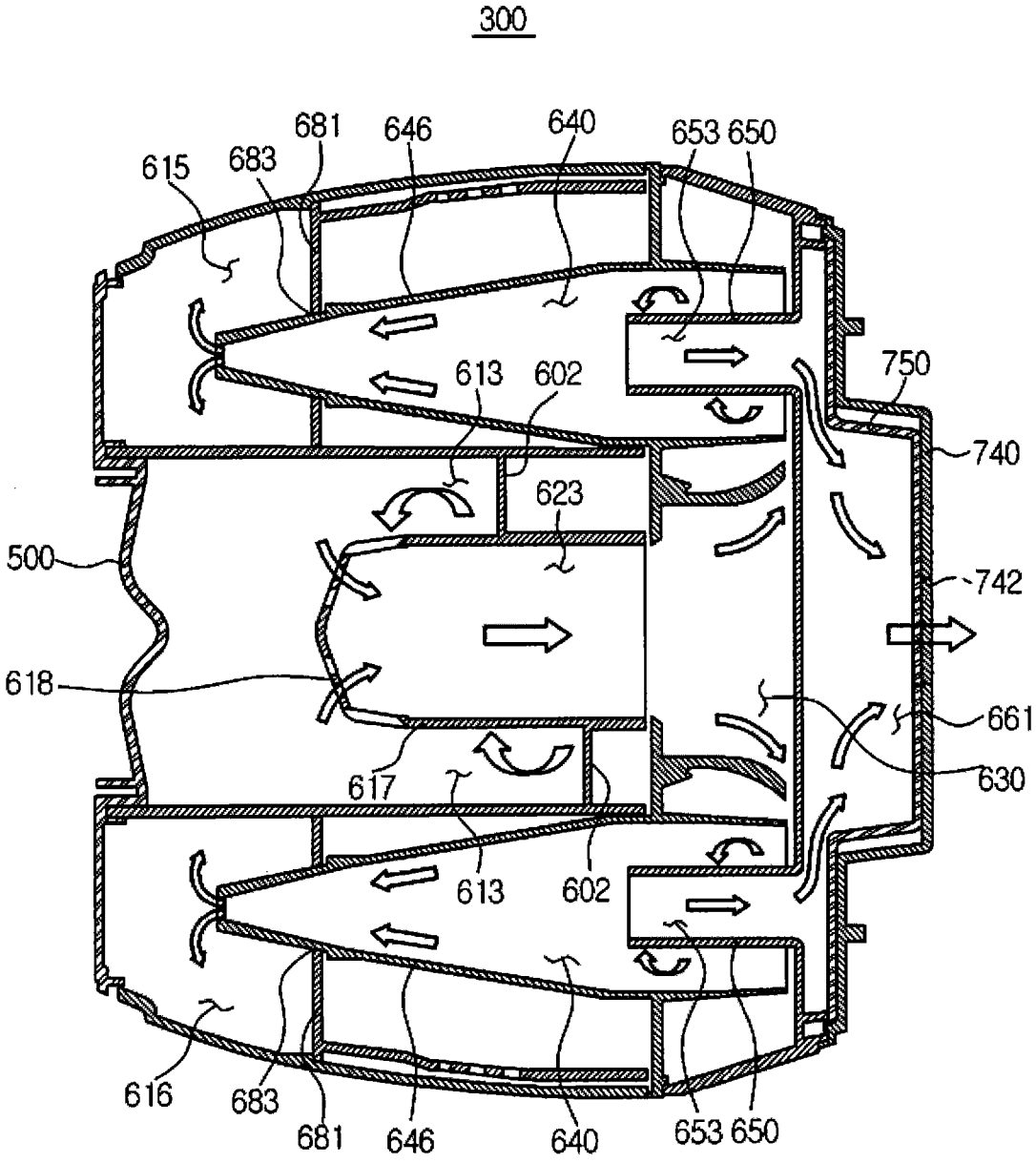
FIG. 16 is a cross-sectional view taken along line III-III of FIG. 8.

Referring to FIGS. 13, 14, and 16, the first cyclone part 613 is provided in an approximate cylindrical shape. The front surface of the first cyclone part 613 is covered by the cover 500. The first cyclone part 613 communicates with the first dust-collecting compartment 614 through an inner wall opening 619. The inner wall opening 619 is provided at one side relative to the center while the guide passage 612 is provided at the other side.

The first purified air exhaust pipe 617 is provided approximately at a center portion inside the first cyclone part 613. A front end of the first purified air exhaust pipe 617 is spaced apart from the cover 599. The front end of the first purified air exhaust pipe 617 is open and the open front end is covered with a grille 618.

A slope plane 602 in a spiral shape is formed at an inner side of the first cyclone part 613 such that the dirt containing air introduced into the first cyclone part 613 through the guide passage 612 form a swirl flow (A). Accordingly, the dirt separated from the dirt-containing air is collected (B) in the first dust-collecting compartment 614 through the inner wall opening 619, and a first purified air, which is obtained by separating dirt, moves to the first purified air exhaust pipe 617 through the grille 618 (C).

The first dust-collecting compartment 614 is formed by the outer wall 600 of the outer case 710, the inner wall 601 of the outer case 710, the cover 500, and the partition part 722 of the inner case 720. The first dust-collecting compartment 614 is partitioned off the second dust-collecting compartments 615 and 616 and the guide passage 612 while communicating with the first cyclone part 613 through the inner wall opening 619. The first dust-collecting compartment 614 is formed at a lower sides of the first cyclone part 613, the second dust collecting compartments 615 and 616, and the guide passage 612.

Figure 18:
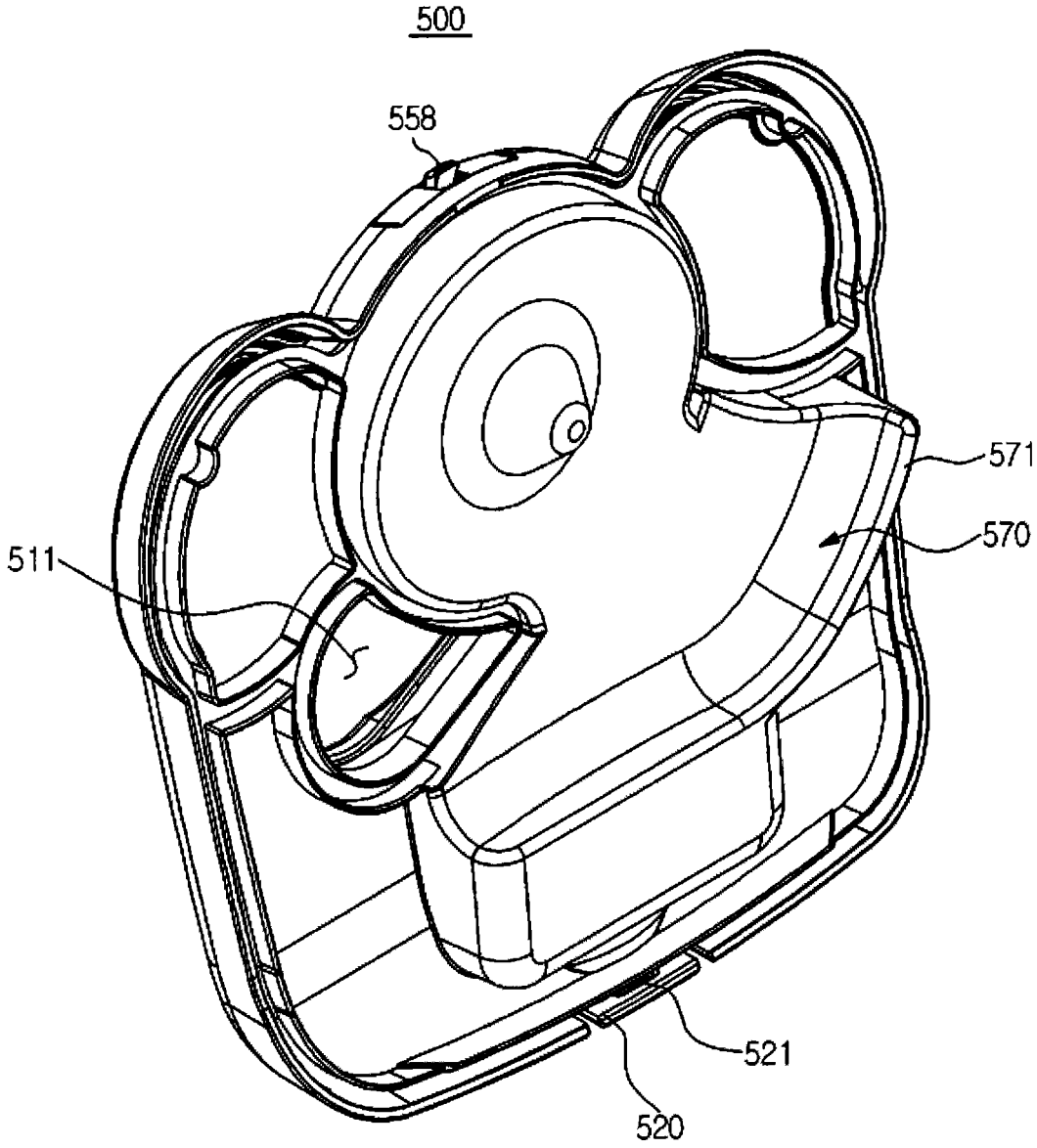
FIG. 18 is a view illustrating a bottom surface of the cover of the dust-separating apparatus of the vacuum cleaner of FIG. 12.

Meanwhile, in order for the dirt separated by the first cyclone part 613 to easily pass through the inner wall opening 619 and then to be collected in the first dust collecting compartment 614, the inner wall 601 forming the first cyclone part 613 is formed to be slightly inclined. In addition, the cover 500 includes a guide part (570 in FIG. 18) that protrudes backward to guide the dirt passing through the inner wall opening 619 to the first dust-collecting compartment 614.

Since the inner wall opening 619 is provided at a side relative to the center portion, the dirt separated by the first cyclone part 613 may be stacked only at a side of the first dust-collecting compartment 614. Accordingly, in order to evenly collect the dirt in the first dust-collecting compartment 614, the guide part 570 includes a slope plane 571 that is tilted toward the inner wall opening 619.

Figure 15:
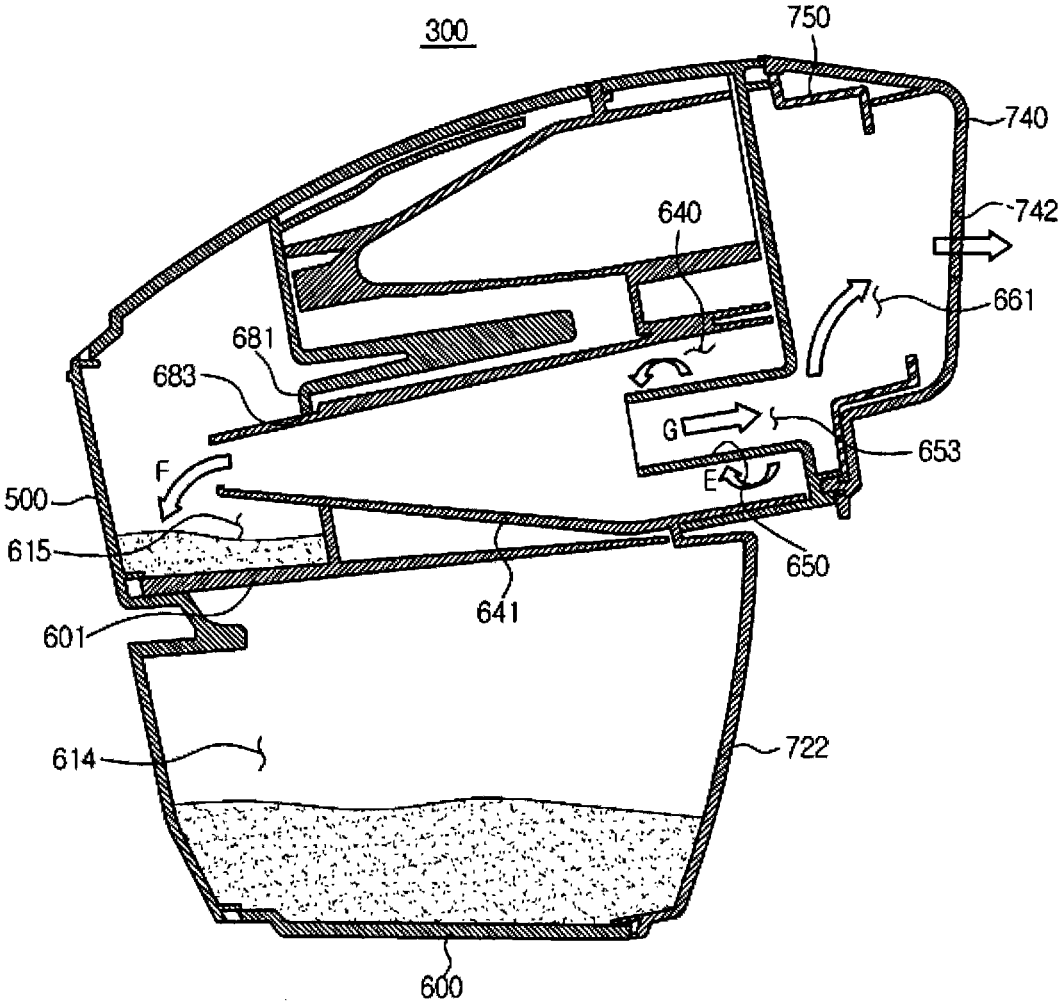
FIG. 15 is a cross-sectional view taken along line II-II of FIG. 8.

Referring to FIGS. 13, 15, and 16, the second dust-collecting compartments 615 and 616 are formed by the outer wall 600 of the outer case 710, the inner wall 601 of the outer case 710, the cover 500, the front surface walls 671 and 681 of the decoration covers 670 and 680, and the second cyclone pipe 641 of the inner case 720.

Accordingly, the second dust-collecting compartments 615 and 616 are partitioned off the first dust-collecting compartment 614 and the first cyclone part 613. A front surface of the second cyclone part 640 forming the second cyclone part 640 is open while being separated from the cover 500, so that the second dust colleting compartments 615 and 616 communicate with the second cyclone part 640.

Figure 17:
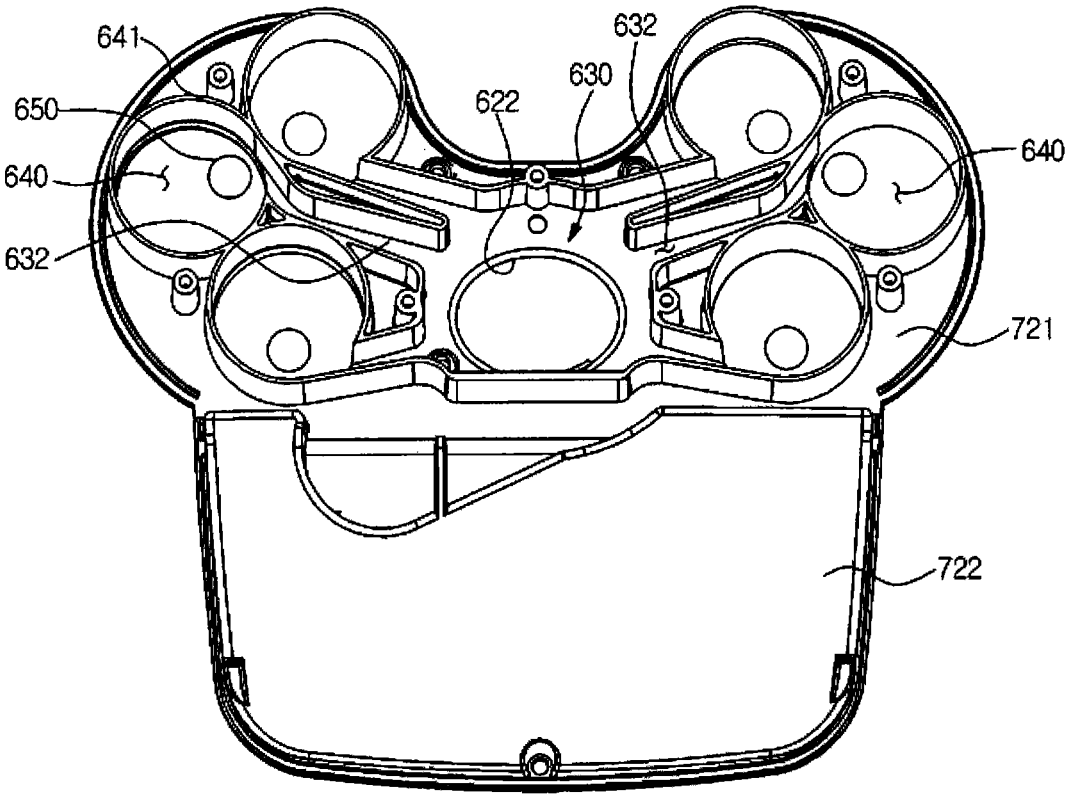
FIG. 17 is a view illustrating a bottom surface of an inner case of the dust-separating apparatus of the vacuum cleaner of FIG. 12.

Meanwhile, referring to FIG. 17, the distribution passage 630 is formed at the bottom surface of the inner case 720 to guide the first purified air exhausted through the first purified air exhaust pipe 617 to the plurality of second cyclone parts 640.

The distribution passage 630 includes a plurality of connection passages 632 configured to connect an exit 622 of the first purified air exhaust pipe 617 to the plurality of second cyclone parts 640 such that the first purified air exhausted through the exit 622 of the first purified air exhaust pipe 617 is guided into the plurality of second cyclone parts 640. Accordingly, the first purified air is guided into the plurality of second cyclone parts 640.

Referring again to FIGS. 13, 15, and 16, the second purified air exhaust pipe 650 is provided at each of the second cyclone parts 640. The front surface and the rear surface of the second purified air exhaust pipe 650 are open. The second purified air purified by the second cyclone part 640 is introduced to the inside the second purified air exhaust pipe 650 through the open front surface.

The plurality of second purified air exhaust pipes 650 communicates with the second purified air joining space 661 provided in the spongy accommodation part 740, so that the second purified air passing through the second purified air exhaust pipe 650 joints at the second purified air joining space 661 and then is exhausted to the dust separating apparatus 300 through the dust-separating apparatus outlet 742.

Through such a structure, referring to FIG. 15, the first purified air introduced into the second cyclone part 640 forms a swirl flow (E) at the second cyclone part 640, and dirt may be separated. The separated dirt, by passing over the open front surface of the second cyclone part 641, is collected at the second dust-separating compartment 615 (F) and the second purified air, from which dirt is removed, is guided to the second purified air joining space 661 through an interior 653 of the second purified air exhaust pipe 650.

As described above, the dust-separating apparatus 300 according to the embodiment of the present disclosure includes the first cyclone part 613 and the second cyclone parts 615 and 616, which form a swirl flow approximately in an horizontal direction, while forming the first dust collecting compartment 614 at a lower side of the first cyclone part 613 and the second cyclone parts 615 and 616 in the gravitational direction.

Accordingly, the size of the first dust-collecting compartment 614 relative to the dust-collecting apparatus 300 is enlarged as compared to a conventional vacuum cleaner. In addition, according to the conventional vacuum cleaner, a first dust-collecting compartment is provided at an outer space of an outer circumferential surface of a first cyclone part having a cylindrical shape and a second cyclone part is formed at a portion of the outer space, so the first dust-collecting compartment has a widely spread dust-collecting space and a complicated shape. However, the first dust-collecting compartment 614 of the dust-separating apparatus 300 according to the embodiment of the present disclosure has a concentrated dust-collecting space and has a simple structure.

Accordingly, such a shape and structure of the first dust-collecting compartment 614 enables more of dirt to be collected with the same volume as the first dust collection compartment of the conventional vacuum cleaner.

Figure 23:
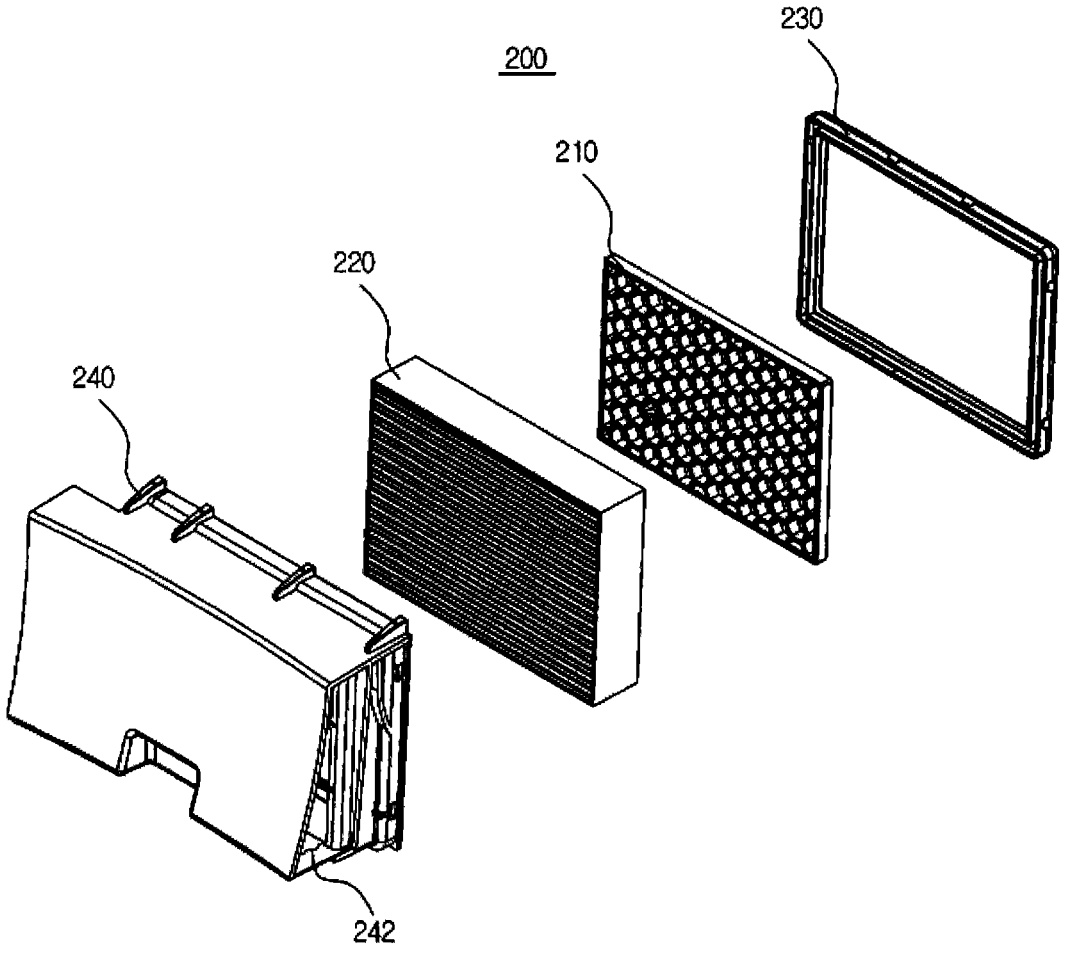
FIG. 23 is a view illustrating the configuration of the filter assembly of the vacuum cleaner of FIG. 1.

FIG. 22 is a view illustrating a state of the body of the vacuum cleaner of FIG. 12 from which a filter assembly is separated. FIG. 23 is a view illustrating the configuration of the filter assembly of the vacuum cleaner of FIG. 1.

Referring to FIGS. 22 and 23, the filter assembly 200 is installed at a filter assembly accommodation part 100 that is provided at a rear side of the dust-separating apparatus accommodation part 80. The fan motor compartment 54 on which the fan motor assembly 110 configured to generate an intake force is disposed at a rear side of the filter assembly accommodation part 100. The air exhausted from the fan motor compartment 54 via a fan motor compartment exit 51 passes through the filter assembly 200.

The filter assembly accommodation part 100 has an upper surface that may be open. The filter assembly 200 is vertically installed or separated with respect to the filter assembly accommodation part 100 through the open upper surface of the filter assembly accommodation part 100.

Meanwhile, if the dust-separating apparatus 300 is installed on the dust-separating apparatus accommodation part 80, the open front surface of the filter assembly accommodation part 100 is covered. Accordingly, the filter assembly 200 is installed on the filter assembly accommodation part 100 after the dust-separating apparatus 300 is separated from the dust-separating apparatus accommodation part 80.

The filter assembly 200 includes a filter cover 230, a carbon filter 210, a HEPA (High-Efficiency Particulate Arresting) filter 220, and a filter case 240. The filter case 240 includes an inner space, which is configured to accommodate the carbon filter 210 and the HEPA filter 220, and a filter outtake port 242 formed at both sides of the filter case 240 to discharge the air purified by passing through the carbon filter 210 and the HEPA filter 220. The filter outtake port 242 is provided to correspond to an interior outtake port 53 of the vacuum cleaner body 10.

Through the above structure, the air purified by sequentially passing through the first cyclone part 613 and the second cyclone part 640 of the dust-separating apparatus 300 is secondarily filter out fine dust by passing through the carbon filter 210 and the HEPA filter 220 of the filter assembly 200, and finally discharged to the outside of the vacuum cleaner body 10.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner comprising:

a body having an intake port configured to take in air and an outtake port configured to discharge air;

a dust-separating apparatus detachably mounted on the body and configured to centrifugate dirt from the air taken in; and a fan motor assembly configured to form an intake force used to take in the air, wherein the dust-separating apparatus comprises:

an outer case;

an inner case having portion disposed inside the outer case;

a cover disposed at an opposite side of the inner case with respect to the outer case; and wherein the outer case comprises:

a guide passage configured to guide air introduced through the dust-separating apparatus inlet to a rear side;

a first cyclone part configured to firstly perform a centrifugation separation on dirt while guiding the air passing through the guide passage to a front side and;

a first dust-collecting compartment configured to collect the dirt separated by the first cyclone part;

a first purified air exhaust pipe configured to guide the air passing through the first cyclone part to the rear side again; and wherein the inner case comprises:

a plurality of second cyclone pipes disposed inside the outer case and configured to secondarily perform a centrifugal separation on dirt while guiding the air passing through the first purified air exhaust pipe to the front side again; and the cover comprises an air inlet connected to the intake port.

2. The cleaner of claim 1, wherein the dust-separating apparatus comprises an inner wall that is configured to divide the guide passage, the first cyclone part, the first dust-collecting compartment, and the second dust-collecting compartment.

3. The cleaner of claim 2, wherein the inner wall has an opening that serves to communicate the first cyclone part with the first dust-collecting compartment.

4. The cleaner of claim 1, wherein the first dust-collecting compartment is formed at a lower side of the first cyclone part.

5. The cleaner of claim 1, wherein the first dust-collecting compartment is formed at a lower side of the second cyclone part.

6. The cleaner of claim 1, wherein the second dust-collecting compartment is formed at both sides of the first cyclone part.

7. The cleaner of claim 1, wherein the dust-separating apparatus comprises a diverge passage configured to guide air passing through the first purified air exhaust pipe to the plurality of second cyclone pipes.

8. The cleaner of claim 1, wherein the dust-separating apparatus further comprises:

a second dust-collecting compartment configured to collect dirt separated by the second cyclone part, which is provided with at least one second cyclone part, a second purified air exhaust pipe configured to guide air passing through the second cyclone part to the rear side again; and a dust separating apparatus outlet connected to the outtake port to exhaust air passing through the second purified air exhaust pipe.

9. A cleaner comprising:

a body having an intake port configured to take in air and an outtake port configure to discharge air;

a fan motor assembly configured to form an intake force used to take in air; and a dust-separating apparatus detachably mounted on the body and configured to separate dirt from the air taken in comprising;

a first cyclone part to firstly perform a centrifugation separation on dirt air taken in;

a pair of second cyclone parts to secondly perform a centrifugation separation on dirt from the air taken in;

wherein the second cyclone parts are located on opposite sides of the first cyclone part to allow the air taken in to be transferred to both of the second cyclone parts from the first cyclone part;

wherein the first cyclone part directs air in a first direction and a first purified air exhaust pipe directs air from the first cyclone part to the second cyclone part in a second direction, wherein second direction is in the opposite direction of the first direction.

* * * * *